US005151356A

United States Patent [19]

Sakanoue et al.

[11] Patent Number: 5,151,356

[45] Date of Patent: Sep. 29, 1992

[54] SILVER HALIDE COLOR PHOTOGRAPHIC MATERIAL

[75] Inventors: Kei Sakanoue; Tsumoru Hirano, both of Kanagawa, Japan

[73] Assignee: Fuji Photo Film Co., Ltd., Kanagawa, Japan

[21] Appl. No.: 492,375

[22] Filed: Mar. 8, 1990

Related U.S. Application Data

[63] Continuation of Ser. No. 95,720, Sep. 14, 1987, abandoned.

[30] Foreign Application Priority Data

Sep. 12, 1986 [JP] Japan ..... 61-215255

[51] Int. Cl.[5] ..... G03C 7/36; G03C 7/26

[52] U.S. Cl. ..... 430/548; 430/226; 430/557; 430/545

[58] Field of Search ..... 430/548, 556, 557, 226, 430/545

[56] References Cited

U.S. PATENT DOCUMENTS 2,890,012 1/1959 Godowsky et al. ..... 430/548
3,926,436 12/1975 Monbaliu et al. ..... 430/548
4,340,664 7/1982 Monbaliu et al. ..... 430/548
4,500,634 2/1985 Sakanoue et al. ..... 430/548
4,650,748 3/1987 Komamura et al. ..... 430/557
4,663,272 5/1987 Nakamura ..... 430/556
4,745,048 5/1988 Kishimoto et al. ..... 430/548

FOREIGN PATENT DOCUMENTS 59336 3/1986 Japan .
73151 4/1986 Japan .

OTHER PUBLICATIONS

Research Disclosure, Sep. 1985, No. 25724.

*Primary Examiner*—Richard L. Schilling
*Attorney, Agent, or Firm*—Sughrue, Mion, Zinn, Macpeak & Seas

[57] ABSTRACT

A silver halide color photographic material comprising a support having provided thereon at least one water-soluble yellow dye-forming polymer coupler containing a repeating unit derived from at least one monomer in which the polymerization moiety is only in a coupling-off group.

15 Claims, No Drawings

SILVER HALIDE COLOR PHOTOGRAPHIC MATERIAL

This is a continuation of application Ser. No. 07/095,720 filed Sep. 14, 1987, now abandoned.

FIELD OF THE INVENTION

This invention relates to a silver halide color photographic material containing a novel water-soluble yellow dye-forming polymer coupler.

BACKGROUND OF THE INVENTION

In recent years, image quality of color light-sensitive materials for photographic use has been improved so much that, in obtaining prints of about service size from 35 mm film, fairly satisfactory graininess and sharpness have been attained.

However, in the case of reducing the film size to, for example, 110-size, disc size, etc., the image quality is still so unsatisfactory with respect to graininess and sharpness that, in consideration of small format photographing materials, improvement of image quality is still an important object with respect to color photography.

As to improvement of sharpness, there are basically two types of techniques; one being a technique of strengthening edge effect using mainly development inhibitor releasing (hereinafter DIR) couplers; the other being a technique of reducing scattering of light in emulsion layers, which is mainly attained by reducing the thickness of the emulsion layers.

Of these, the technique of using DIR couplers is effective for improving sharpness in a comparatively low frequency region of MTF curve (MTF curve being described in *The Theory of the Photographic Process*, 3rd Ed. (compiled by T. H. James and published by Macmillan Co.), p. 536). In consideration of enlarging a small format photographic material, improvement of MTF in a comparatively high frequency region is of importance as described in U.S. Pat. No. 4,500,634 and Japanese Patent Application (OPI) No. 36249/84 (the term "OPI" as used herein refers to a "published unexamined Japanese patent application"). In order to attain the improvement in a high frequency region, a great reduction in the thickness of emulsion layers is necessary as has been described hereinbefore. As to techniques for reducing the thickness, various techniques are disclosed in the aforesaid published application, which discloses that the use of a polymer coupler, i.e., a coupler having a polymerizing moiety, is effective.

In general, blue-sensitive layers are preferably provided as uppermost layers in photographing materials in view of color reproduction, etc. Therefore, it is of extreme importance to reduce the thickness of the blue-sensitive layer.

Processes for adding a polymer coupler to a hydrophilic colloidal medium to disperse the coupler in the medium are basically grouped into two types. One type is a process of forming latex particles by emulsion polymerization as described in U.S. Pat. Nos. 3,370,952, 4,080,211 and 3,451,820, and adding them to an emulsion, or a process of dissolving in a solvent a polymer coupler obtained by solution polymerization, emulsifying and dispersing the resulting solution, and adding the dispersion to an emulsion.

The other type is a process of introducing a water-soluble group (a hydrophilic group) into a polymer coupler to render the coupler water-soluble, and adding the polymer coupler to a hydrophilic colloidal medium. In this case, the polymer coupler is considered to be intimately mixed with the hydrophilic colloidal medium without forming a latex.

In this specification, the former polymer couplers are referred to as oil-soluble polymer couplers since they have an extremely small solubility in water and are readily soluble in high boiling organic solvents, and the latter polymer couplers as water-soluble couplers since they are water-soluble.

Oil-soluble polymer couplers can contain color-forming units in a high density and can be applied using only a small amount of, or no, high boiling organic solvents, thus enabling reduction in the thickness of the emulsion layer. In Japanese Patent Application (OPI) No. 73151/86, an oil-soluble dye-diffusion type yellow polymer coupler latex is disclosed.

However, they have a serious defect in that, as the amount of hydrophilic colloidal medium (gelatin being often used) is reduced for reducing the thickness of the emulsion layer, film strength becomes weak since oil-soluble polymer couplers are soft in comparison to gelatin. Even if the above polymer coupler latex is used, reduction in the film strength cannot be avoidable since the polymer coupler itself is oil-soluble.

On the other hand, the water-soluble polymers can be coexistent with gelatin and, if necessary, a hardener capable of forming a network structure with gelatin or a group capable of reacting with such hardener may be introduced thereto, and hence the water-soluble polymer couplers in principle permit reduction in the thickness without sacrificing film strength in comparison with the oil-soluble polymer couplers.

As yellow dye-forming water-soluble polymer couplers, U.S. Pat. Nos. 3,211,552, 3,299,013 and 3,424,583 and Japanese Patent Publication Nos. 18466/61, 13375/69 and 16184/68 describe 4-equivalent yellow dye-forming water-soluble polymer couplers, and U.S. Pat. Nos. 4,207,109 and 4,215,195 describe 2-equivalent yellow dye-forming water-soluble polymer couplers. However, these water-soluble polymer couplers have been found to have a serious defect that the dark heat fading properties under wet heat conditions after color development are deteriorated.

SUMMARY OF THE INVENTION

It is, therefore, an object of the present invention to provide a silver halide color photographic material having an excellent color image preservability by using a novel yellow dye-forming water-soluble polymer coupler.

Another object of the present invention is to provide a silver halide color photographic material excellent in sharpness by using a yellow dye-forming polymer coupler capable of providing excellent film strength and permitting enough reduction in thickness of the emulsion layer.

A further object of the present invention is to provide a silver halide color photographic material showing excellent graininess by using a novel water-soluble yellow dye-forming polymer coupler.

Still a further object of the present invention is to provide a silver halide color photographic material containing a reduced amount of coupler by using a novel water-soluble yellow dye-forming polymer coupler having sufficient reactivity and producing dyes in good yield.

These and other objects of the present invention will become apparent from the following description thereof.

As a result of intensive investigations, it has now been found that the above-described and other objects of the present invention are attained by a silver halide color photographic material comprising a support having provided thereon at least one water-soluble yellow dye-forming polymer coupler containing a repeating unit derived from at least one monomer in which the polymerization moiety is only in a coupling-off group (i.e., a group capable of being eliminated by coupling reaction with an oxidation product of a color developing agent).

DETAILED DESCRIPTION OF THE INVENTION

The present invention will be described in detail below.

The monomer in which the polymerization moiety is in a group capable of being eliminated by coupling reaction with an oxidation product of a color developing agent is preferably represented by formula (I):

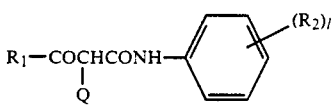

(I)

wherein $R_1$ represents an alkyl group or an aryl group; $R_2$ represents a monovalent group; Q represents a group having an ethylenically unsaturated group and capable of being eliminated by a coupling reaction with an oxidation product of a color developing agent; and l represents an integer of from 0 to 5.

In the silver halide color photographic material of the present invention, the water-soluble yellow dye-forming polymer coupler is preferably incorporated by first adding it to a coating solution as a solution in water, a water-soluble organic solvent, an alkali-containing aqueous solution, or a mixture thereof, and coating and drying the coating solution.

$R_1$ in formula (I) represents an alkyl group or an aryl group. As the alkyl group, straight or branched alkyl groups containing 3 to 20 carbon atoms are preferable, with straight or branched alkyl groups containing 4 to 8 carbon atoms (for example, a tert-butyl group, an n-butyl group, an n-amyl group, a tert-amyl group, a secamyl group, an n-octyl group, a tert-octyl group, etc.) being more preferable. Most preferably, $R_1$ represents a tert-butyl group. The alkyl group includes a cycloalkyl group (for example, a cyclohexyl group, an adamantyl group, etc.), and may further have 1 or more substituents. Examples of the substituent include a halogen atom (e.g., a chlorine atom, a bromine atom, etc.), an alkoxy group (e.g., a methoxy group, an ethoxy group, etc.), an aryloxy group (e.g., a phenoxy group, a tolyloxy group, etc.), and an aryl group (e.g., a phenyl group, a naphthyl group, etc.).

As the aforesaid aryl group represented by $R_1$, a phenyl group is preferable, and the aryl group may have a substituent or substituents. As the substituents for the aryl group, there are illustrated a halogen atom (e.g., a fluorine atom, a chlorine atom, a bromine atom, etc.), an alkyl group containing 1 to 8 carbon atoms (e.g., a methyl group, an ethyl group, an isopropyl group, a tert-butyl group, a sec-amyl group, a tert-octyl group, etc.), an alkoxy group (e.g., a methoxy group, an ethoxy group, etc.), an aryloxy group (e.g., a phenoxy group, etc.), an alkylsulfonamido group (e.g., a methanesulfonamido group, an ethanesulfonamido group, etc.), an arylsulfonamido group (e.g., a phenylsulfonamido group, etc.), an alkoxycarbonyl group (e.g., a methoxycarbonyl group, an ethoxycarbonyl group, etc.), an aryloxycarbonyl group (e.g., a phenyloxycarbonyl group, etc.), an acylamino group (e.g., an acetylamino group, a pivaloylamino group, etc.), an alkylsulfamoyl group (e.g., a methylsulfamoyl group, a dimethylsulfamoyl group, etc.), an arylsulfamoyl group (e.g., a phenylsulfamoyl group, etc.), an alkylcarbamoyl group (e.g, a methylcarbamoyl group, etc.), an arylcarbamoyl group (e.g., a phenylcarbamoyl group, etc.), an alkylsulfonyl or arylsulfonyl group (e.g., a methylsulfonyl group, a phenylsulfonyl group, etc.), a nitro group, and a cyano group. Two or more of these substituents may exist and, in such a case, the two substituents may be the same or different. As the substituents for the phenyl group represented by $R_1$, an alkoxy group, a halogen atom, an alkyl group, and an alkylsulfonamido group are preferable.

As the monovalent group represented by $R_2$ in formula (I), there are illustrated a halogen atom, an alkyl group containing 1 to 8 carbon atoms, an alkoxy group, an aryloxy group, an alkylsulfonamido group, an arylsulfonamido group, an alkoxycarbonyl group, an aryloxycarbonyl group, an acylamino group, an alkylsulfamoyl group, an arylsulfamoyl group, an alkylcarbamoyl group, an arylcarbamoyl group, a sulfonyl group, a nitro group, a cyano group, etc. Of these, a halogen atom, an alkoxy group, an alkylsulfonamido group, an acylamino group, and an alkoxycarbonyl group are preferable. l represents an integer of 0 to 5 and, when l represents 2 or more, $R_2$ groups may be the same or different.

Q represents a group having an ethylenically unsaturated group and capable of being eliminated by a coupling reaction with an oxidation product of a color developing agent, and is preferably represented by formula (II):

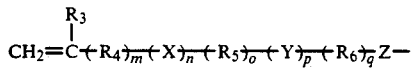

(II)

wherein $R_3$ represents a hydrogen atom, a halogen atom or an alkyl group, preferably an alkyl group, and most preferably a lower alkyl group containing 1 to 4 carbon atoms (e.g., a methyl group, an ethyl group, etc.). This alkyl group may have one or more substituents. Examples of the substituent include a halogen atom (e.g., a chlorine atom, a bromine atom, etc.), an alkoxy group (e.g., a methoxy group, an ethoxy group, etc.), an aryloxy group (e.g., a phenoxy group, a tolyloxy group, etc.), and an aryl group (e.g., a phenyl group, a naphthyl group, etc.).

$R_4$, $R_5$ and $R_6$ in formula (II) each represents an alkylene group containing 1 to 20 carbon atoms, an arylene group, or an aralkylene group. The alkylene group may be of a straight or branched chain. As the alkylene group, there are illustrated, for example, a methylene group, a methylmethylene group, a dimethylene group, a decamethylene group, etc. As the arylene group, there are illustrated, for example, a phenylene group and a naphthylene group. As the aralkylene group represented by $R_4$, $R_5$ or $R_6$, there are illustrated a benzylidene group, etc.

The alkylene, arylene or aralkylene group represented by $R_4$, $R_5$ or $R_6$ may have a substituent or substituents and, as the substituent, there are illustrated, for example, an alkyl group, a halogen atom, an alkoxy group, etc.

X in formula (II) represents a linking group, such as —CONH—, —NHCO—, —NHCONH—, —COO—, —OCO—, —$SO_2$—, —S—, —CO—, —SO— or —O—. Of these, —CONH—, —NHCONH—, —COO—, —$SO_2$—, —S— and —O— are preferable.

Y in formula (II) represents a divalent linking group, such as —CONH—, —NHCO—, —NHCONH—, —COO—, —OCO—, —$SO_2$NH—, —NH$SO_2$— or —$SO_2$—. Of these, —CONH—, —OCO—, —$SO_2$NH— and —$SO_2$— are preferable.

m, n, o, p and q each represents 0 or 1.

Z represents a coupling-off group. i.e., a group capable of being eliminated by the coupling reaction with an oxidation product of a color developing agent, and can be represented by formula (III) or (IV):

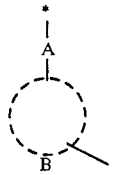

(III)

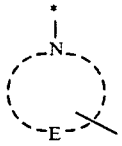

(IV)

wherein * represents a position to be bound to the active site of the coupler, A represents an oxygen atom or a sulfur atom, B represents a non-metallic atomic group necessary for forming an aryl ring or a heterocyclic ring, and E represents a non-metallic atomic group necessary for forming a 5- or 6-membered heterocyclic ring together with the nitrogen atom. These rings may further be fused with an aryl ring or a heterocyclic ring.

Examples of Z represented by formula (III) include a divalent group derived from an aryloxy group, an oxazolyloxy group, a chroman-4-oxy group, a tetrazolyloxy group, an arylthio group or the like, and examples of Z represented by formula (IV) include a divalent group derived from a urazol group, a hydantoin group, a tetrazolone group, a triazole group, a diazole group, a succinimido group, a saccharin group, a pyridone group, a pyridazone group, an oxazolinedione group, a thiazolidinedione group, etc., preferably a divalent group derived from an aryloxy group, a urazol group, a hydantoin group, a tetrazolone group, or a pyrazole group.

Z represented by formula (III) or (IV) may further have one or more substituents, and such substituents include an alkyl group, an aryl group, an aralkylene group, a halogen atom, an alkoxy group, a hydroxy group, a nitro group, an amino group, a carboxylic acid ester group, a carboxylic acid group, a sulfonic acid group, etc.

Specific examples of the coupler monomers represented by formula (I) are illustrated below which, however, do not limit the present invention in any way.

(1)

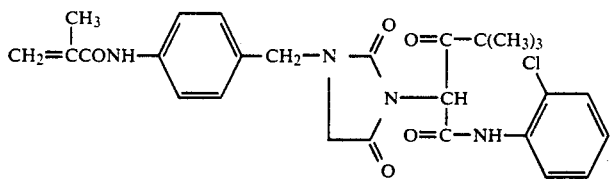

(2)

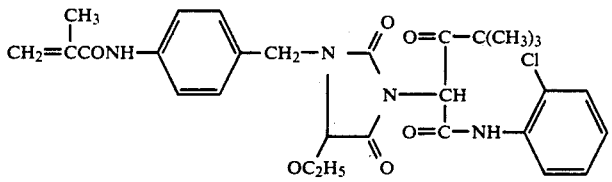

(3)

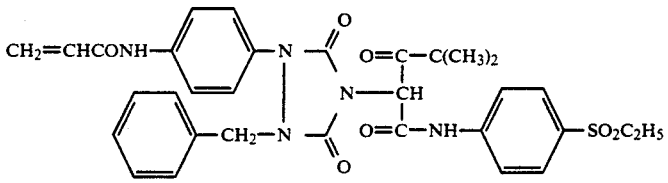

-continued
(4)
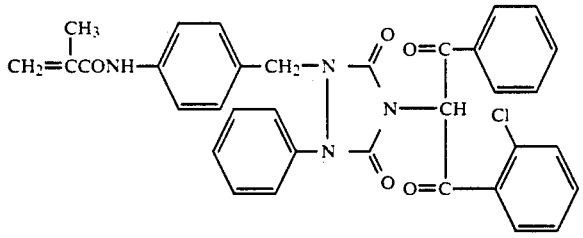
(5)
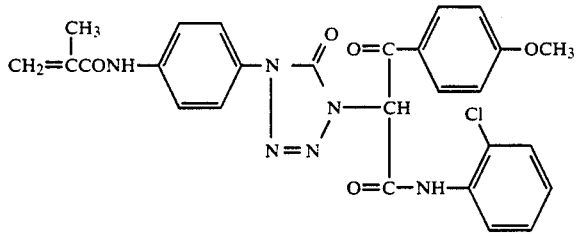
(6)
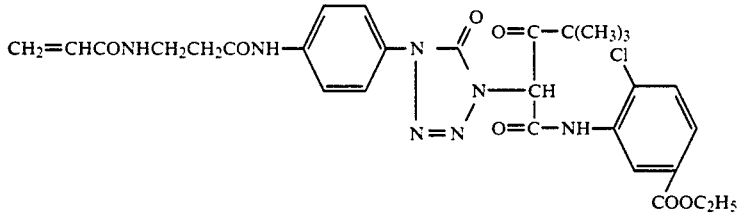
(7)
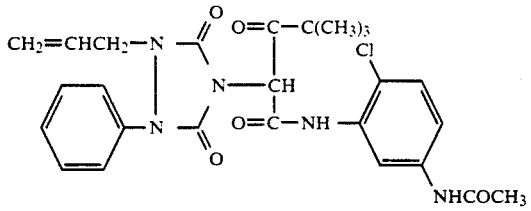
(8)
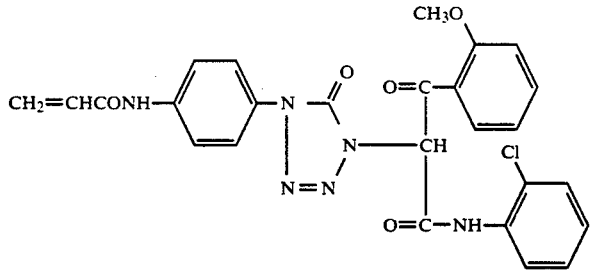
(9)
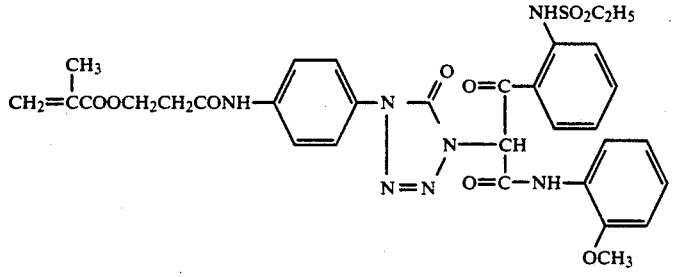

-continued
(10)
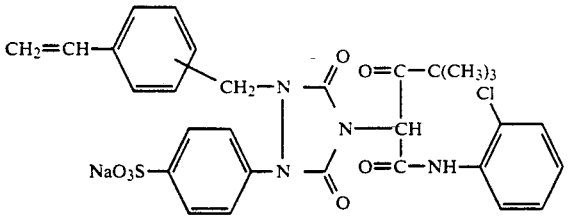
(11)
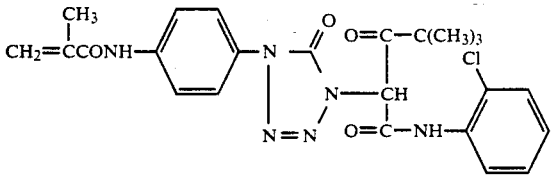
(12)
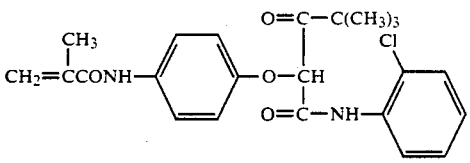
(13)
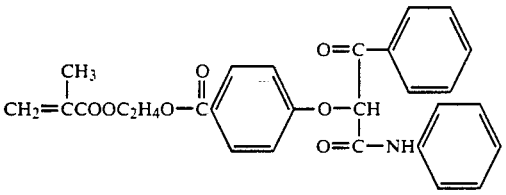
(14)
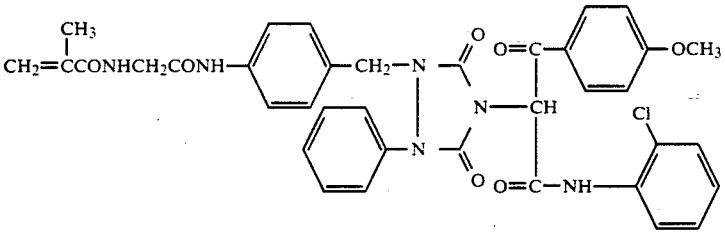
(15)
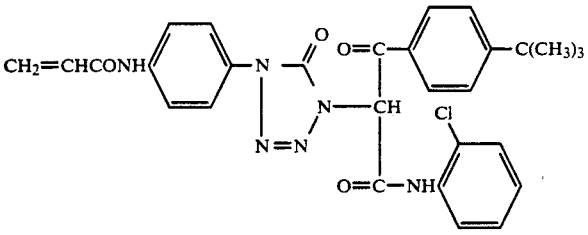
(16)
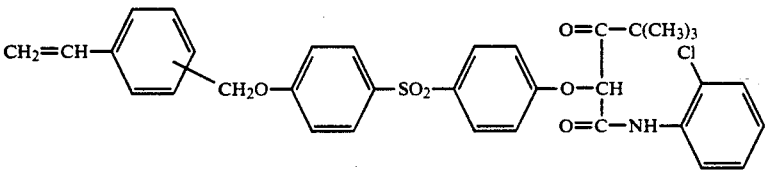

-continued
(17)
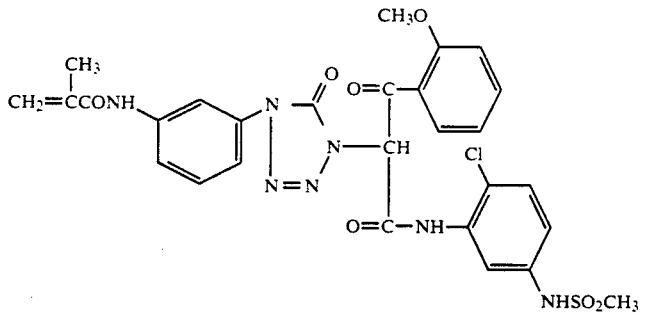
(18)
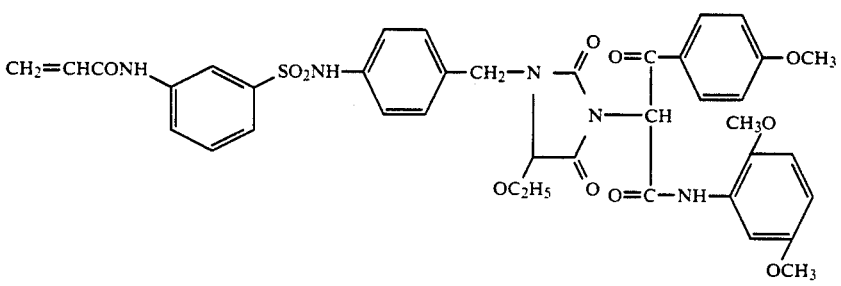
(19)
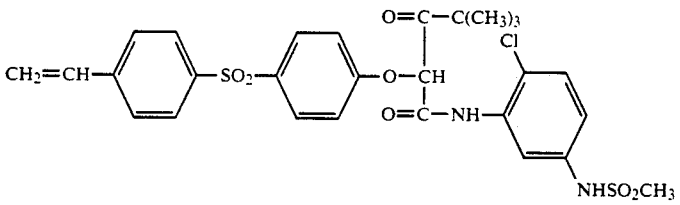
(20)
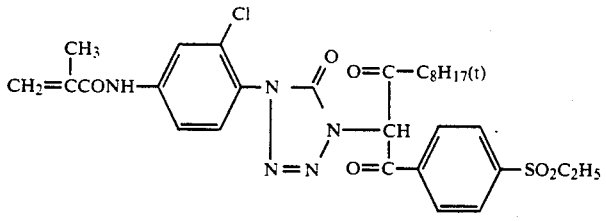
(21)
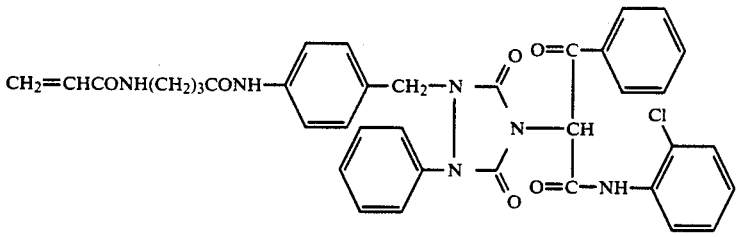
(22)
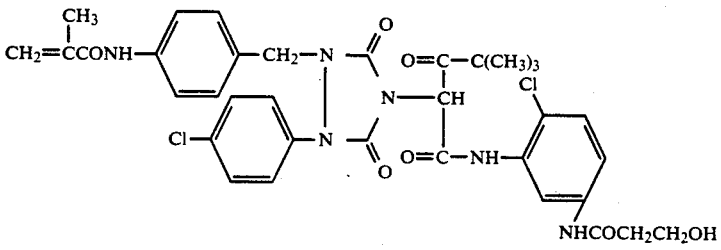

-continued
(23)
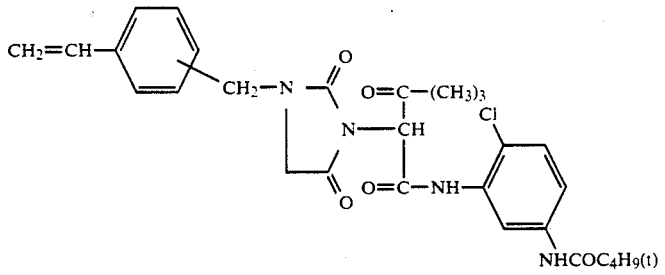
(24)
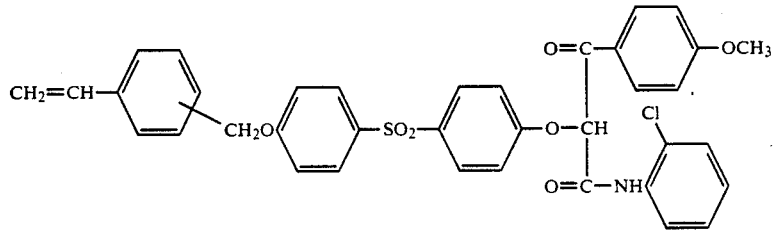
(25)
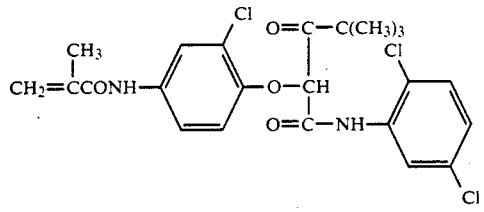
(26)
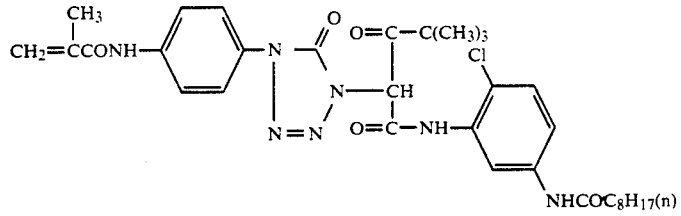
(27)
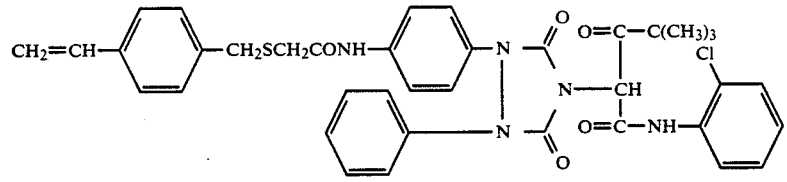
(28)
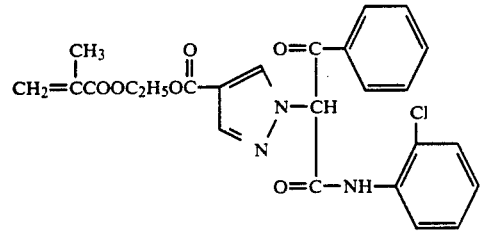

-continued
(29)
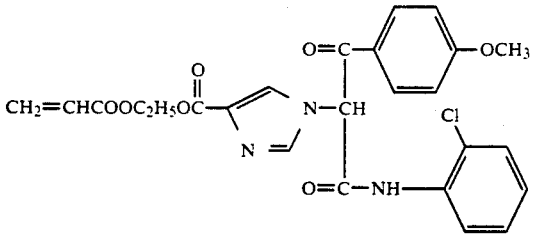
(30)
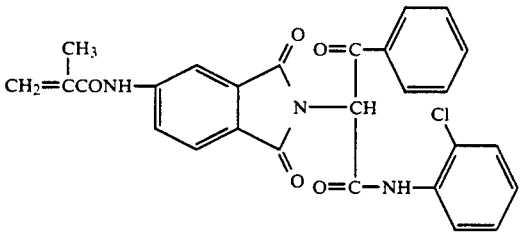
(31)
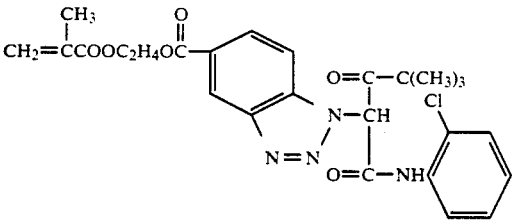
(32)
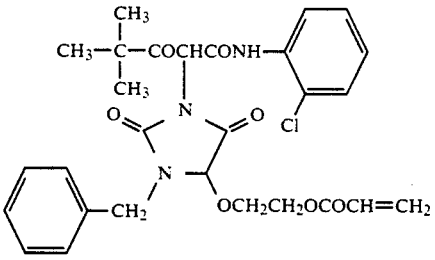
(33)
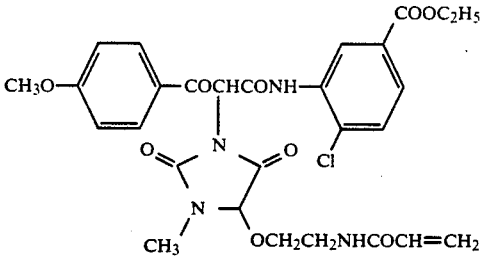
(34)
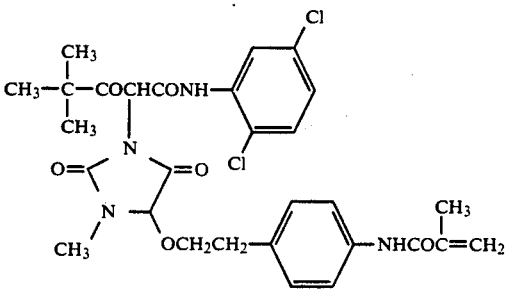

-continued
(35)
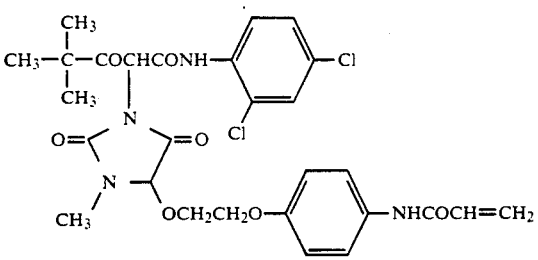
(36)
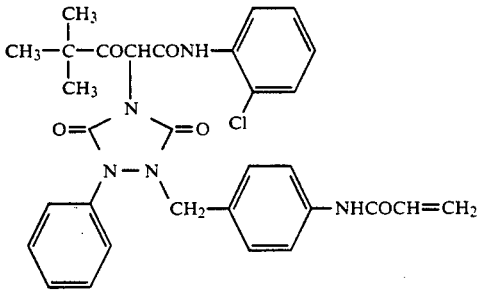
(37)
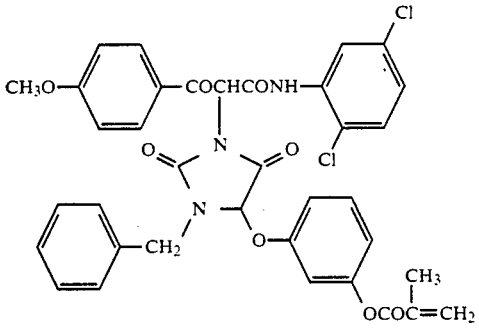
(38)
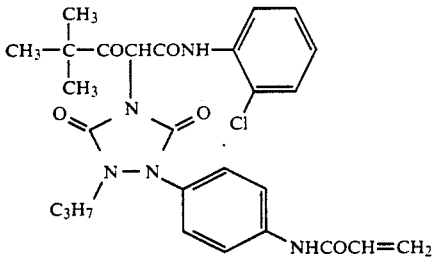
(39)
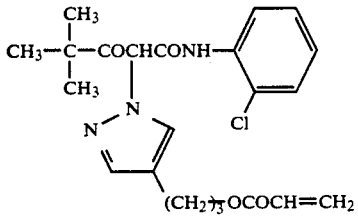
The ethylenic coupler monomers to be used in the present invention may easily be synthesized according to conventionally known processes. One example of a synthesis route is shown below.

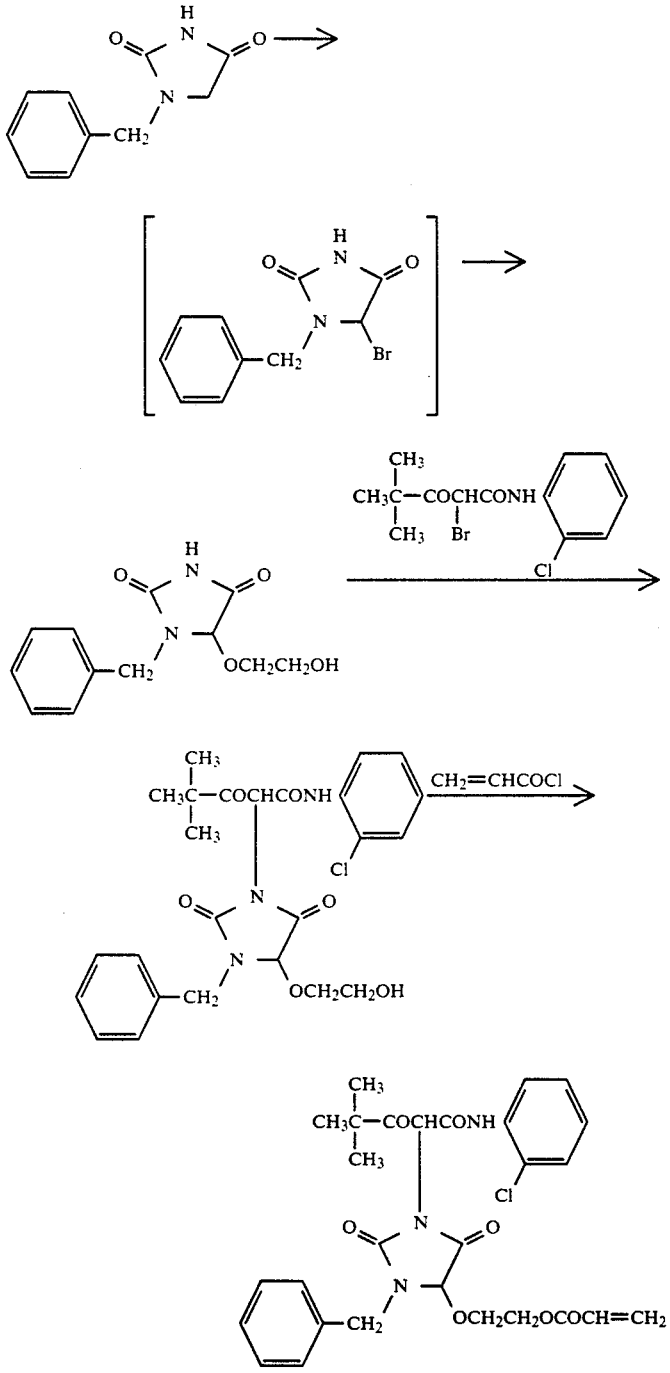

Examples of synthesizing the ethylenic coupler monomers are shown below. Unless otherwise indicated herein, all parts, percents, ratios and the like are by weight.

Synthesis of Monomer (32)

500 ml of acetic acid was added to 57 g of 1-benzylhydantoin and, while maintaining at 80° C. with stirring, 50.3 g of bromine was dropwise added thereto. After completion of the dropwise addition, the solution was further stirred for 2 hours. The reaction solution was then cooled and, while cooling with ice, 56 g of ethylene glycol was added thereto. After stirring for 30 minutes, the solution was further stirred for 3 hours at room temperature. One liter of water was added to the reaction solution, followed by extraction with 500 ml of ethyl acetate. The extract was further washed twice with 500 ml of water. The thus obtained ethyl acetate solution was dried with sodium sulfate, concentrated, and purified by silica gel chromatography to obtain 52 g of 1-benzyl-5-(2-hydroxyethoxy)hydantoin. (Yield: 74%)

51.5 g of 1-benzyl-5-(2-hydroxyethoxy)hydantoin and 20 g of triethylamine were dissolved in 500 ml of methylene chloride, and a solution of 34.8 g of α-bromo-α-pivaloyl-2-chloroacetanilide in 200 ml of methylene chloride was dropwise added thereto in about 1 hour. After completion of the dropwise addition, the solution was stirred for 2 hours. Then, the reaction solution was washed twice with 300 ml of dilute hydrochloric acid, and twice with 300 ml of water. After drying the reaction solution with sodium sulfate, it was concentrated and purified by silica gel chromatography to obtain 42.2 g of oily α-pivaloyl-α-(1-benzyl-5-(2-hydroxyethoxy)-hydantoin-3-yl)-2-chloroacetanilide. (Yield: 84%)

25.1 g of α-pivaloyl-α-[1-benzyl-5-(2-hydroxyethoxy)hydantoin-3-yl]-2-chloroacetanilide and 6 g of pyridine were dissolved in 300 ml of methylene chloride, and 5 g of acrylic acid chloride was dropwise added thereto under cooling with ice. After completion of the dropwise addition, the solution was stirred for 2 hours at room temperature, then washed with dilute hydrochloric acid and water successively. The methylene chloride solution was dried with sodium sulfate, concentrated, then purified by silica gel column chromatography to obtain 22.6 g of the end product, Monomer (32) (Yield: 81%). The structure of the product was determined by using NMR spectrum and mass spectrum.

Synthesis of Monomer (39)

56.7 g of 4-(3-hydroxypropyl)pyrazole and 45.5 g of triethylamine were dissolved in 500 ml of chloroform and, under cooling with ice, a solution of 88.8 g of α-bromo-2-pivaloyl-2-chloroacetanilide in 300 ml of chloroform was dropwise added thereto in about 1 hour. After completion of the dropwise addition, the solution was stirred for 2 hours, and the reaction solution was washed twice with 300 ml of dilute hydrochloric acid, then twice with 500 ml of water. The reaction solution was dried with anhydrous sodium sulfate, concentrated, and purified by silica gel chromatography to obtain 88.2 g of oily α-pivaloyl-α-[4-(3-hydroxypropyl)-pyrazolyl]-2-chloroacetanilide. (Yield: 78%)

75.4 g of α-pivaloyl-α-[4-(3-hydroxypropyl)-pyrazolyl]-2-chloroacetanilide, 20.9 g of pyridine, and 300 ml of acetonitrile were mixed, and 21.7 g of acrylic acid chloride was dropwise added thereto under cooling with ice. After completion of the dropwise addition, the solution was stirred for 2 hours, then extracted with ethyl acetate, and the extract was washed with water. The extract was then dried with anhydrous sodium sulfate, concentrated, and purified by silica gel column chromatography to obtain 58.7 g of Monomer (39). (Yield: 75%)

The structure of the monomer was determined by using NMR spectrum and mass spectrum.

As non-color-forming ethylenic monomers not coupling with an oxidation product of an aromatic primary amine developing agent, there are illustrated, for example, acrylic acid, acrylic esters, methacrylic esters, crotonic acid, crotonic acid esters, vinyl esters, maleic acid, maleic acid diesters, fumaric acid, fumaric acid diesters, itaconic acid, itaconic acid diesters, acrylamides, methacrylamides, vinyl ethers, styrene, etc. These acids may be in a salt form with an alkali metal (e.g., Na, K, etc.) or an ammonium ion.

More specific examples of these monomers include acrylic esters, e.g., methyl acrylate, ethyl acrylate, n-propyl acrylate, isopropyl acrylate, n-butyl acrylate, 3-acryloylpropanesulfonic acid, acetoacetoxyethyl acrylate, acetoxyethyl acrylate, phenyl acrylate, 2-methoxyethyl acrylate, 2-ethoxyethyl acrylate, 2-(2-methoxyethoxy)ethyl acrylate, etc., methacrylic esters, e.g., methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate, etc., crotonic acid esters, e.g., butyl crotonate, hexyl crotonate, etc., vinyl esters, e.g., vinyl acetate, vinyl propionate, vinyl butyrate, vinyl methoxyacetate, vinyl benzoate, etc., maleic acid diesters, e.g., diethyl maleate, dimethyl maleate, dibutyl maleate, etc., fumaric acid diesters, e.g., diethyl fumarate, dimethyl fumarate, dibutyl fumarate, etc., itaconic acid diesters, e.g., diethyl itaconate, dimethyl itaconate, dibutyl itaconate, etc., acrylamides, e.g., acrylamide, methylacrylamide, ethylacrylamide, isopropylacrylamide, n-butylacrylamide, hydroxymethylacrylamide, diacetoneacrylamide, acryloylmorpholine, acrylamido-2-methylpropanesulfonic acid, etc., methacrylamides, e.g., methylmethacrylamide, ethylmethacrylamide, n-butylmethacrylamide, tert-butylmethacrylamide, 2-methoxymethacrylamide, dimethylmethacrylamide, diethylmethacrylamide, etc., vinyl ethers, e.g., methyl vinyl ether, butyl vinyl ether, hexyl vinyl ether, methoxyethyl vinyl ether, dimethylaminoethyl vinyl ether, etc., and styrenes, e.g., styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinylbenzoate, 2-methylstyrene, styrenesulfonic acid, styrenesulfinic acid, vinyl benzoate, etc.

Examples of other monomers include allyl compounds (e.g., allyl acetate, etc.), vinyl ketones (e.g., methyl vinyl ketone, etc.), vinylheterocyclic compounds (e.g., vinylpyridine, etc.), glycidyl esters (e.g., glycidyl acrylate, etc.), and unsaturated nitriles (e.g., acrylonitrile, etc.).

Of these monomers, those with high hydrophilicity are particularly preferable. These monomers may be used alone or in combination. Examples of the combination of two or more of the monomers include a combination of potassium styrenesulfinate and acrylamide, sodium 2-methylpropanesulfonate, a combination of acetoacetoxyethyl methacrylate and sodium 3-acryloylpropanesulfonate, a combination of acetoacetoxyethyl acrylate and sodium acrylate, and a combination of potassium styrenesulfinate, butyl acrylate, and sodium styrenesulfonate.

The proportion of color-forming moiety (repeating unit) corresponding to the monomer of formula (I) in the polymer coupler of the present invention is preferably 5 to 80 wt % and, in view of color reproduction, color formation, and stability, a proportion of 30 to 70 wt % is more preferable. An equivalent molecular weight (gram number of the polymer containing 1 mol of the monomer coupler) is preferably from about 250 to about 4,000, though not being limited thereto.

The polymer coupler of the present invention preferably has a molecular weight of $5\times10^3$ to $1\times10^7$. If the molecular weight is too small, the polymer is liable to migrate whereas, if too large, its coating can involve some troubles. The molecular weight is more preferably $1\times10^4$ to $2\times10^6$.

Synthesis of the water-soluble polymer coupler of the present invention is conducted using, as a polymerization initiator and a polymerization solvent, those compounds which are described in U.S. Pat. Nos. 4,474,870, 4,436,808, 4,455,366, 4,668,613, 4,540,654, 4,576,910 and 4,522,916, and Japanese Patent Application (OPI) Nos. 120252/83, 145944/83, 211756/83, 224352/83, 42543/84, 171956/84, 228252/84, 35732/85 and 46555/85.

The polymerization temperature is selected in connection with the molecular weight of the polymer, the kind of initiator, etc. The polymerization temperatures of lower than 0° C. to higher than 100° C. are employable, but preferably the polymerization is conducted at 30° C. to 100° C.

The term "water-soluble" as used herein in the present invention means that the polymer coupler dissolves in water in a concentration of 1.0 wt % or more. The polymer couplers with a solubility of 10 wt % or more in water are preferable in view of preparing the light-sensitive material.

The polymer coupler of the present invention may be added in the form of an aqueous solution to a coating solution, and may also be added in the form of a solution in a mixed solvent of a water-miscible organic solvent such as a lower alcohol, THF, acetone, ethyl acetate or the like and water.

Further, the polymer coupler may be added by dissolving in an alkaline aqueous solution or an alkaline water-containing organic solvent solution.

In every case, the water-soluble polymer coupler of the present invention is not in an oil droplet form nor a latex form in the coating solution and in the coated layer, thus being considered to mutually act with, and have some compatibility with, a hydrophilic binder.

This seems to be the reason for the polymer couplers of the present invention showing excellent properties, e.g., film strength, in comparison with oil-soluble polymer couplers (including latex state couplers).

Examples of the water-soluble yellow polymer couplers of the present invention are illustrated below which, however, do not limit the present invention in any way. (Copolymerization ratio is presented by weight.)

cp-1

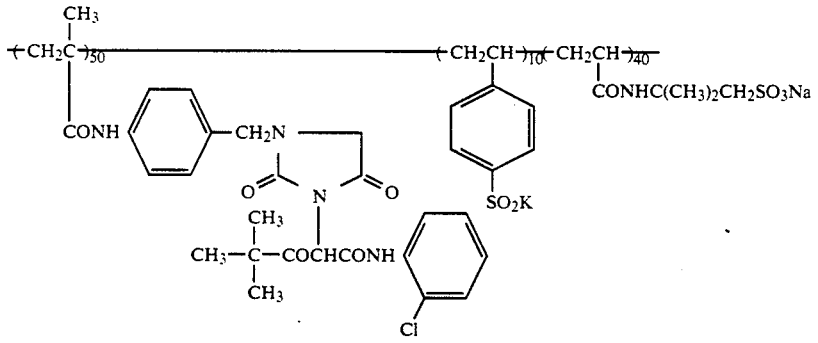

cp-2

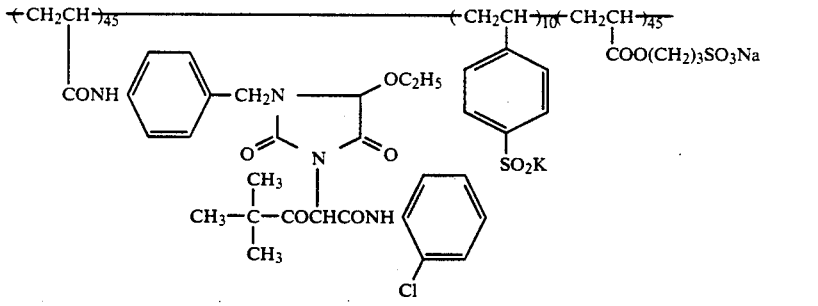

cp-3

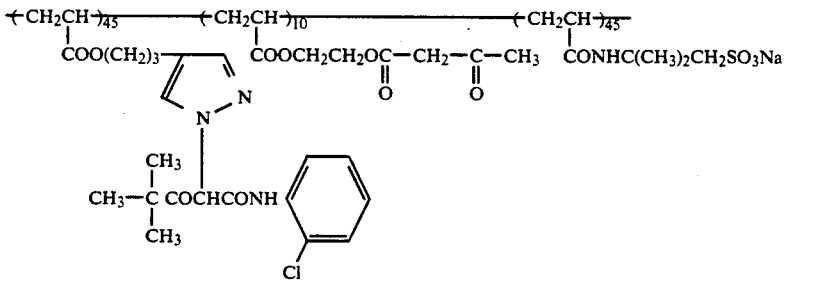

-continued
cp-4
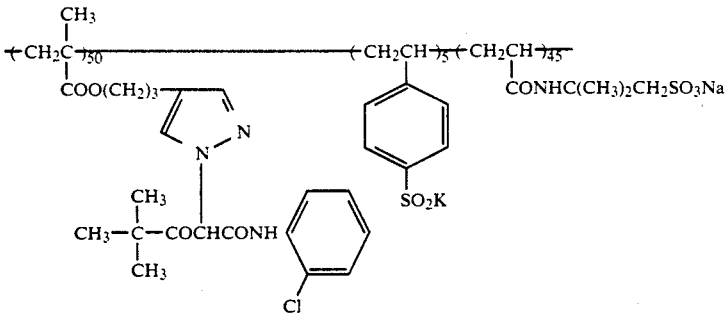
cp-5
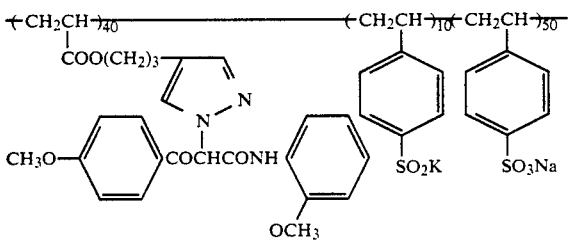
cp-6
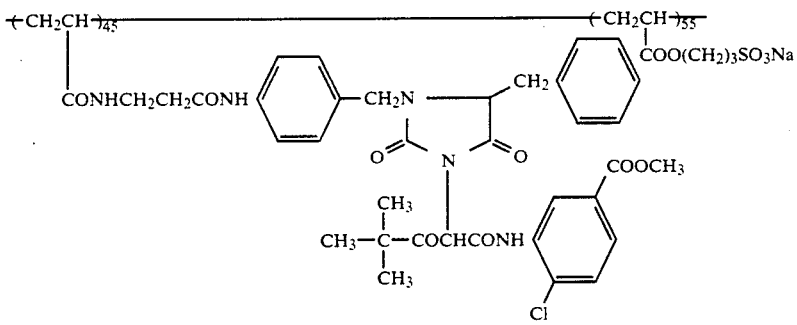
cp-7
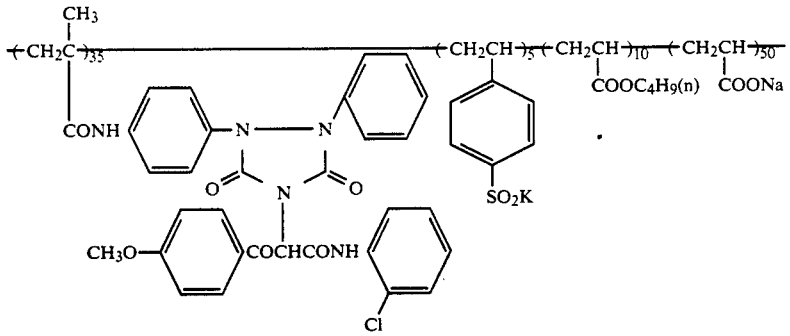
cp-8
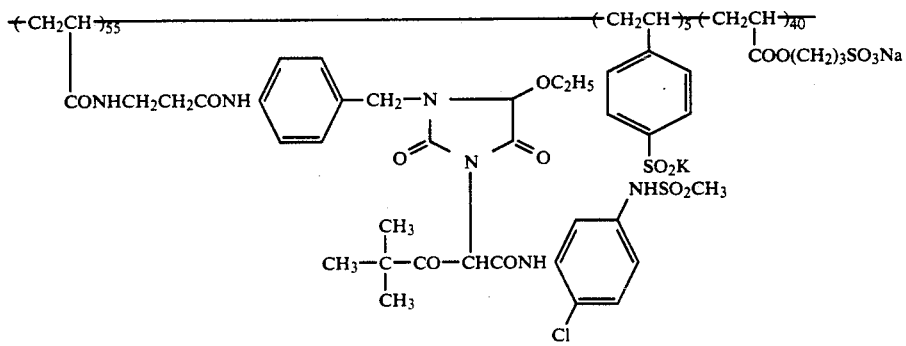

-continued
cp-9
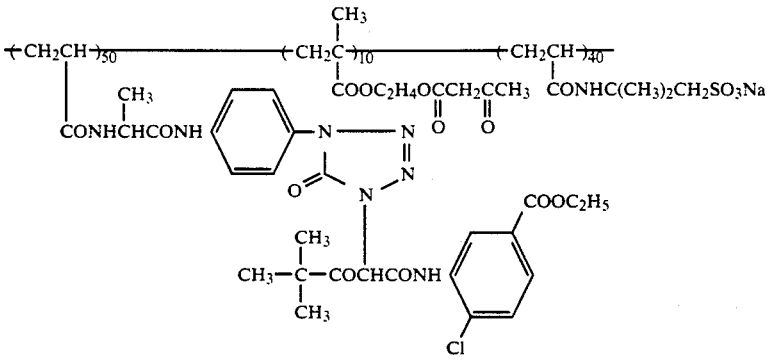
cp-10
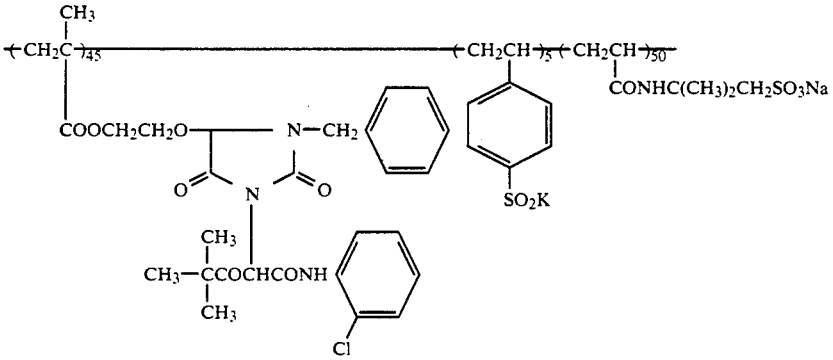
cp-11
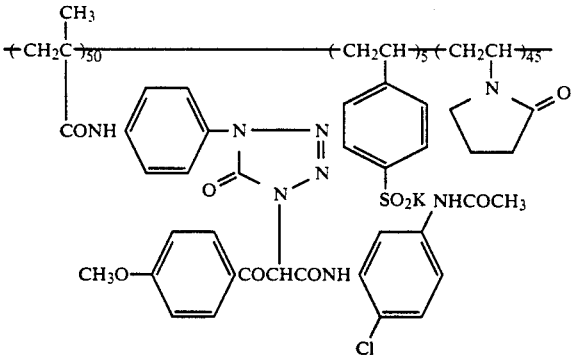
cp-12
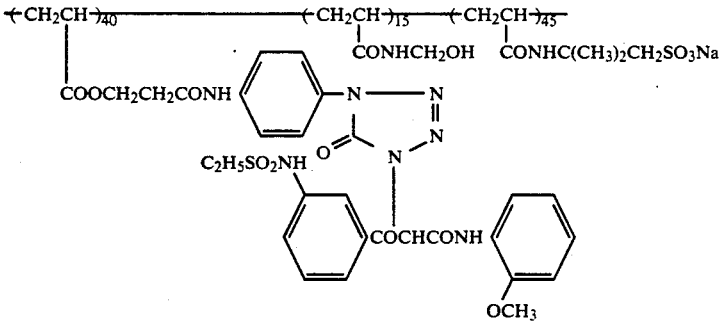

-continued
cp-13
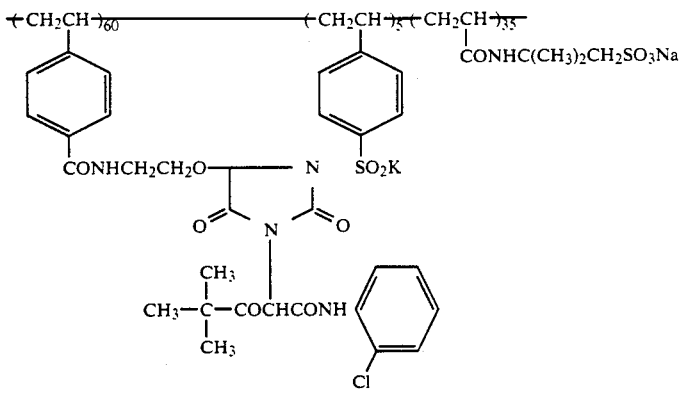
cp-14
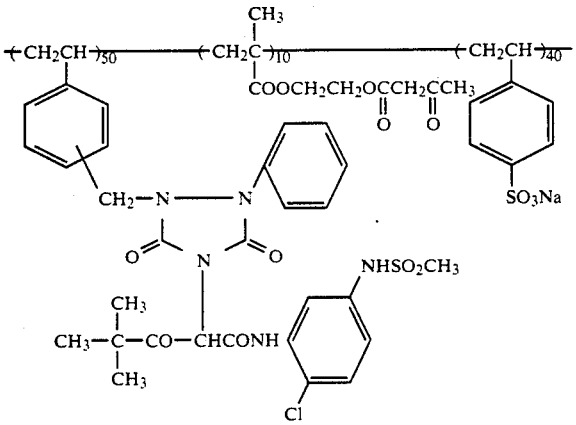
cp-15
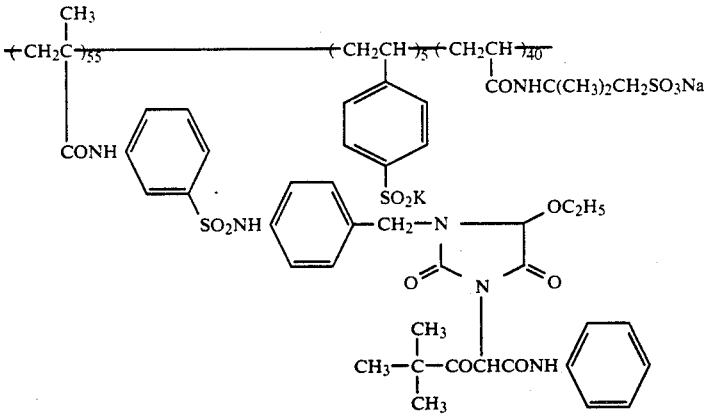
cp-16
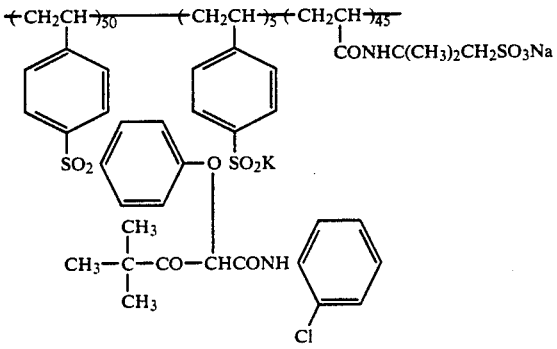

-continued
cp-17
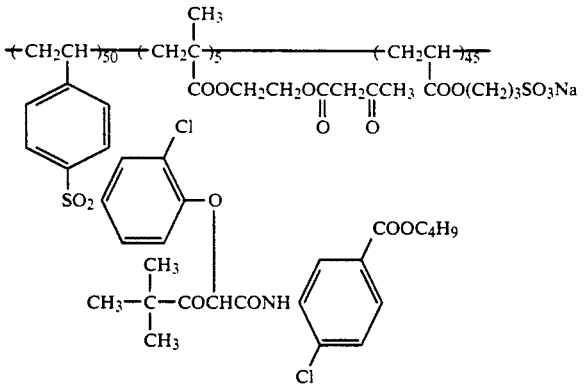
cp-18
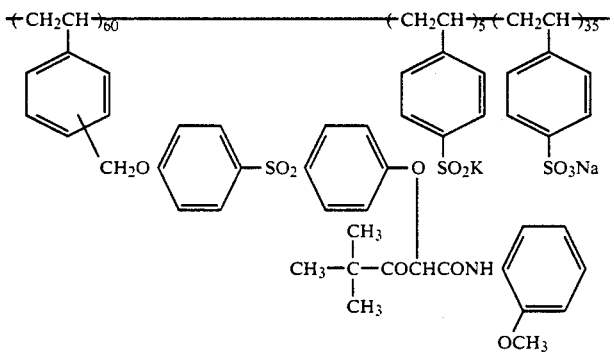
cp-19
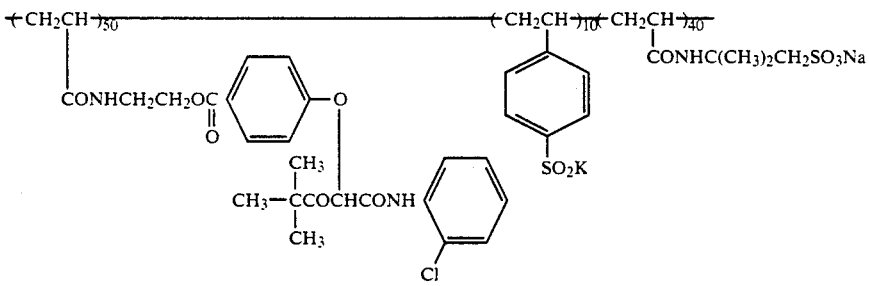
cp-20
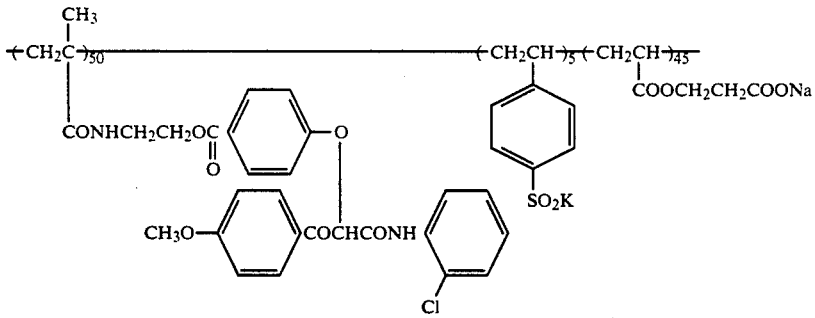
cp-21
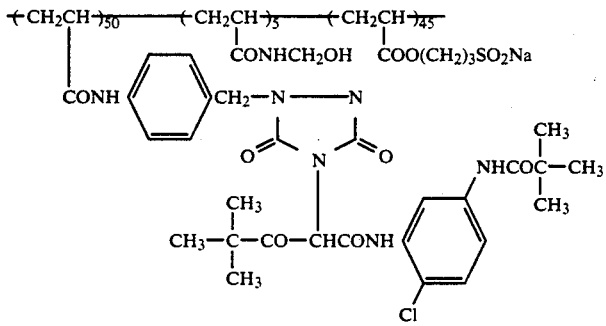

-continued
cp-22
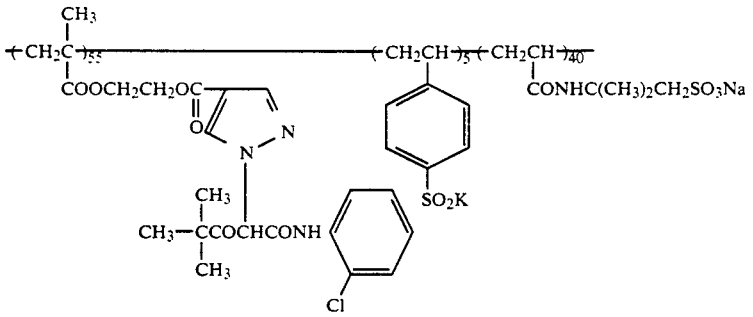
cp-23
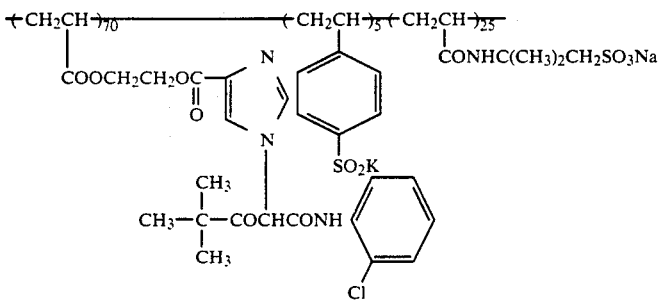
cp-24
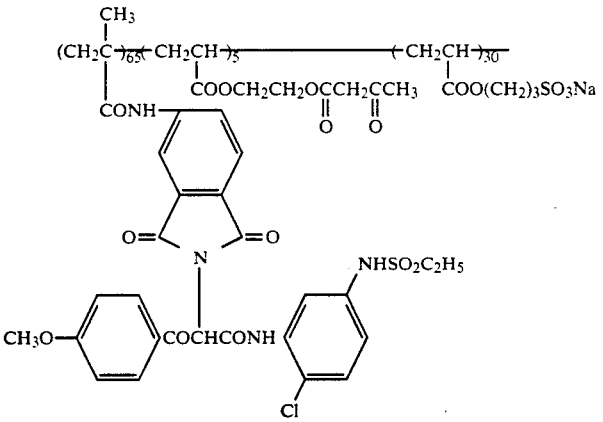
cp-25
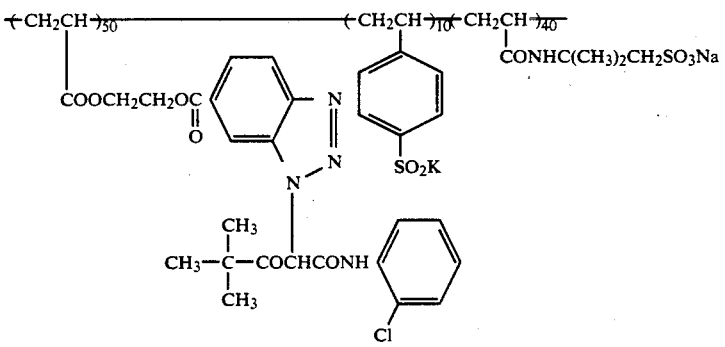

-continued
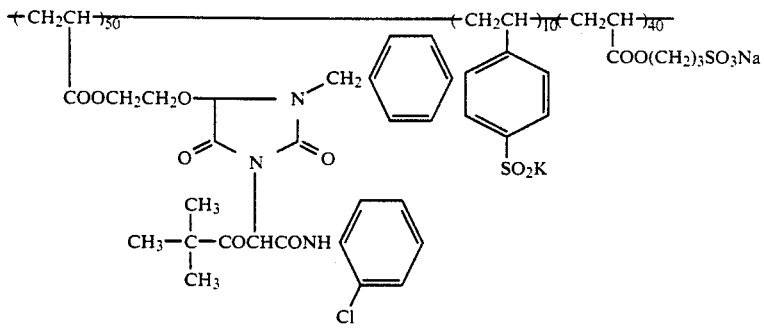
cp-26
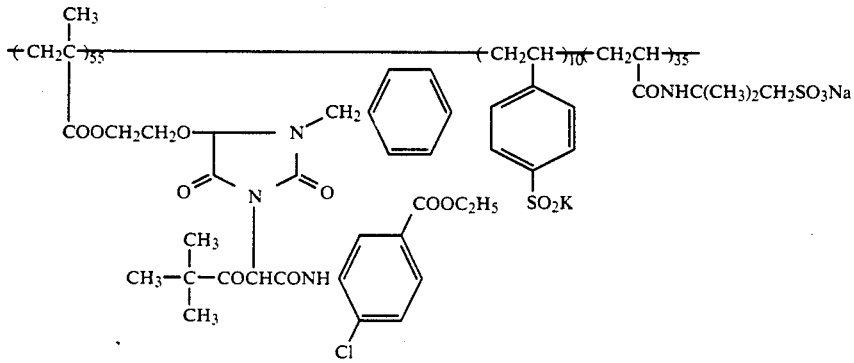
cp-27
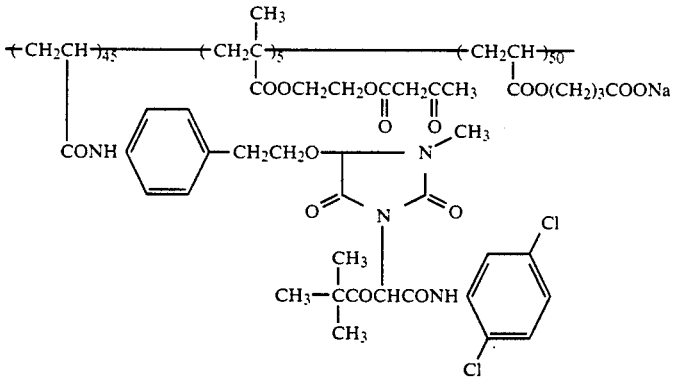
cp-28
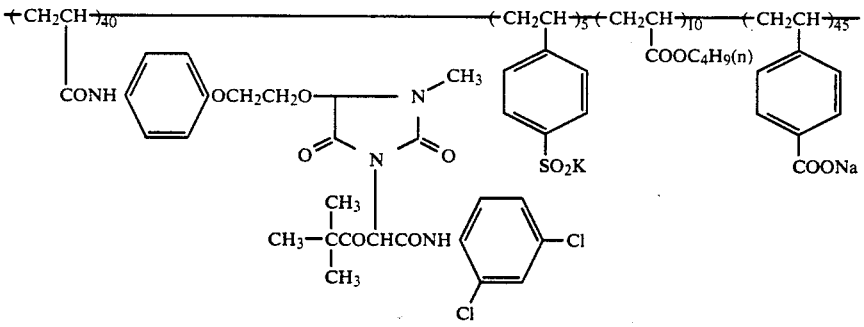
cp-29
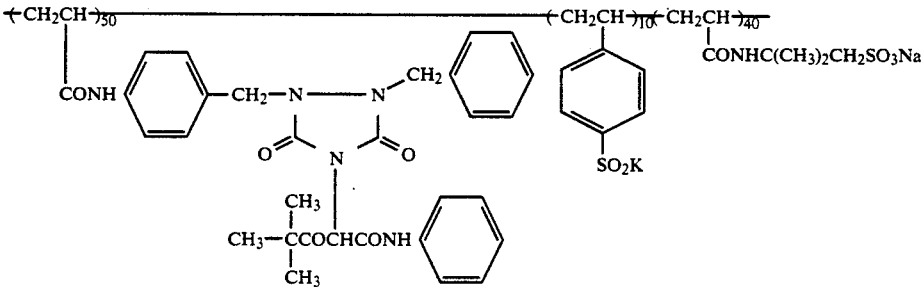
cp-30

-continued

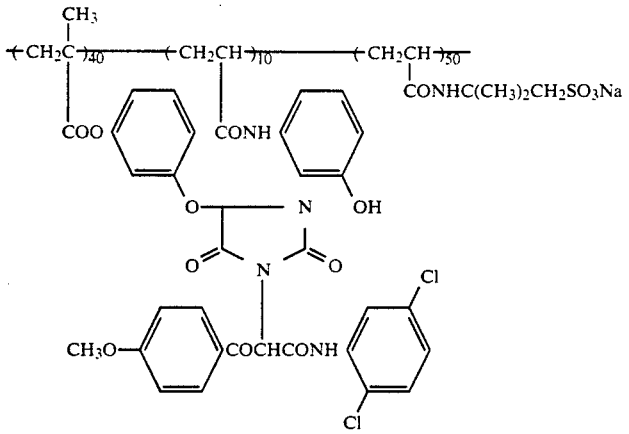

cp-31

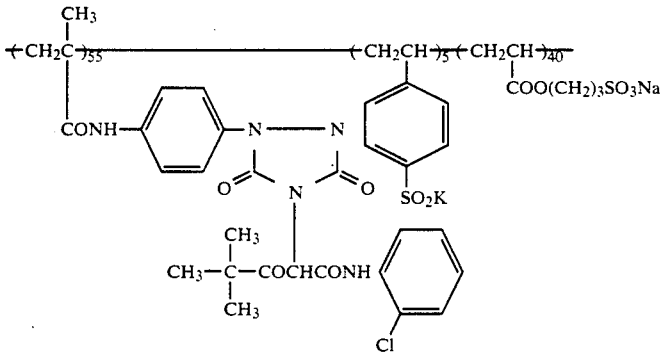

cp-32

Typical examples of synthesizing the polymer couplers to be used in the present invention are shown below.

POLYMERIZATION EXAMPLE 1

Synthesis of poly{α-pivaloyl-α-[4-(3-acryloyloxypropyl)pyrazolyl]-2-chloroacetanilide-co-potassium vinylbenzenesulfinate-co-sodium acrylamido-2-methylpropanesulfonate} (cp-3):

9 g of Monomer (39), 2 g of potassium vinylbenzenesulfinate, 9 g of sodium 2-acrylamido-2-methylpropanesulfonate, and 100 ml of DMSO were added to a 200 ml three-neck flask and, after well purging the flask with a nitrogen gas, the mixture was heated to 75° C. Then, 5 ml of DMSO containing dissolved therein 0.2 g of dimethyl azobisisobutyrate was added thereto, followed by continuing the heating for 6 hours. The reaction mixture was then cooled to room temperature, and added to 700 ml of acetone. A precipitate thus formed was collected by filtration, then dried in vacuo to obtain 17.2 g of Polymer Coupler (cp-3).

POLYMERIZATION EXAMPLE 2

Synthesis of poly{α-pivaloyl-α-[1-benzyl-5-(2-acryloyloxyethoxy)hydantoin-3-yl]-2-chloroacetanilide-co-potassium vinylbenzenesulfinate-co-sodium 3-acryloylpropanesulfonate} (cp-26):

10 g of Monomer (32), 2 g of potassium vinylbenzenesulfinate, 8 g of sodium 2-acryloylpropanesulfonate, and 100 ml of DMF were added to a 200 ml three-neck flask and, after well purging the flask with a nitrogen gas, the mixture was heated to 70° C. Then, 5 ml of DMF containing dissolved therein 0.3 g of dimethyl azobisisobutyrate was added thereto, followed by continuing the heating for 6 hours. The reaction mixture was cooled to room temperature, and added to 700 ml of ethyl ether. A precipitate thus formed was collected by filtration, then dried in vacuo to obtain 18.1 g of Polymer Coupler (cp-26).

POLYMERIZATION EXAMPLE 3

Synthesis of poly{α-4-methoxybenzoyl-α-[4-(2-methacrylamidoethyloxycarbonyl)phenoxy]-2-chloroacetanilide-copotassium vinylbenzenesulfinate-co-sodium acryloyloxypropanoate} (cp-20);

10 g of Monomer (13), 1 g of potassium vinylbenzenesulfinate, 9 g of sodium 3-acryloyloxypropanoate, and 100 ml of DMAC were added to a 200 ml three-neck flask and, after well substituted with a nitrogen gas and degassed, the mixture was heated to 80° C. Then, 0.3 g of azobisisobutyronitrile was added thereto, followed by continuing the heating for 5 hours. The reaction mixture was cooled to room temperature, and added to 800 ml of acetone. A precipitate thus formed was collected by filtration, then dried in vacuo to obtain 17.6 g of Polymer Coupler (cp-20).

The water-soluble polymer couplers to be used in the present invention are preferably incorporated in a blue-sensitive emulsion layer but, in some case, they may be incorporated in other light-sensitive layers or light-insensitive interlayers. In the case of incorporating the polymer couplers in emulsion layers, they are preferably used in an amount (as color-forming units) of $1\times10^{-3}$ mol to 1 mol, more preferably $1\times10^{-3}$ mol to 0.2 mol, per mol of silver halide. In the case of incorporating them in light-insensitive interlayers, they are preferably used in an amount of 0.1 to 1.0 g/m$^2$.

The yellow coupler mother nuclei to be used in the present invention are roughly grouped into α-pivaloylacetanilide type nuclei and α-benzoylacetanilide type nuclei. α-Pivaloylacetanilide type nuclei have a smaller molar extinction coefficient than α-benzoylacetanilide type nuclei, and hence they are disadvantageous with respect to coloration density, but are advantageous in view of color image fastness, hue, etc., thus being preferably used in the present invention.

Silver halide to be preferably incorporated in the photographic emulsion layers of the photographic light-sensitive material of the present invention includes silver chloride, silver chlorobromide, silver bromide, silver bromoiodide, silver chloroiodide, and silver chlorobromoiodide. The couplers of the present invention can be used for photographic materials containing silver halide having any halide composition.

Silver halide grains in the photographic emulsion may be in a regular crystal form such as cubic, octahedral, or tetradecahedral, in an irregular crystal form such as spherical or tabular, in a form with crystal defect such as twin plane, or in a composite form thereof.

As to grain size of silver halide grains, both fine grains of not larger than about 0.1 μm and large grains of up to about 10 μm in projected area diameter may be used. The emulsion may be a polydispersed emulsion or a monodispersed emulsion.

The silver halide photographic emulsion to be used in the present invention may be prepared according to processes described in, for example, *Research Disclosure* (*RD*), No. 17643 (December, 1978), pp. 22 and 23, "I. Emulsion Preparation and types"; ibid., No. 18716 (November, 1979), p. 648; P. Glafkides, *Chimie et Physique Photographique*, (Paul Montel, 1967); G. F. Duffin, *Photographic Emulsion Chemistry* (Focal Press, 1966); V. L. Zelikman et al., *Making and Coating Photographic Emulsion* (Focal Press, 1964); etc.

Monodispersed emulsions described in U.S. Pat. Nos. 3,574,628 and 3,655,394, British Patent 1,413,748, etc., are also preferable.

Tabular grains of about 5 or more in aspect ratio are also usable in the present invention. Such tabular grains may be easily prepared according to processes described in Gutoff, Photographic Science and Engineering, Vol. 14, pp. 248 to 257 (1970); U.S. Pat. Nos. 4,434,226, 4,414,310, 4,433,048 and 4,439,520, British Patent 2,112,157, etc.

The crystal structure of the silver halide grains may be a uniform structure, a structure wherein the inner portion and the outer portion are different in halide composition, or a layered structure, or silver halide crystals different from each other may be joined to each other by epitaxial conjunction or, further, crystals joined to compounds other than silver halide such as rhodanide or lead oxide may be used. In addition, a mixture of grains of various crystal forms may also be used.

The silver halide emulsions are usually subjected to physical ripening, chemical ripening, and/or spectran sensitization before use. Additives to be used in these steps are described in *Research Disclosure*, Nos. 17643 and 18716. The portions where such additives are described are tabulated in the table shown hereinafter.

Conventional photographic additives to be used in the present invention are also described in the above-mentioned *Research Disclosures*, and the portions where they are described are also tabulated in the following table.

| Kind of Additive | RD 17643 | RD 18716 |
|---|---|---|
| 1. Chemical Sensitizers | p. 23 | p. 648, right column |
| 2. Sensitivity-Increasing Agents | | " |
| 3. Spectral Sensitizing Agents and Supersensitizing Agents | pp. 23 and 24 | p. 648, right column to p. 649, right column |
| 4. Brightening Agents | p. 24 | |
| 5. Antifoggants and Stabilizers | pp. 24 and 25 | p. 649, right column |
| 6. Light Absorbents, Filter Dyes, and UV Ray Absorbents | pp. 25 and 26 | p. 649, right column to p. 650, left column |
| 7. Stain-Preventing Agents | p. 25, right column | p. 650, left to right column |
| 8. Dye Image Stabilizers | p. 25 | |
| 9. Hardeners | p. 26 | p. 651, left column |
| 10. Binders | p. 26 | " |
| 11. Plasticizers and Lubricants | p. 27 | p. 650, right column |
| 12. Coating Aids and Surfactants | pp. 26 and 27 | " |
| 13. Antistatic Agents | p. 27 | p. 650, right column |

Various color couplers may be used in the present invention, and specific examples thereof are described in the patent publications described in the foregoing *Research Disclosure* (*RD*), No. 17643, VIII-C to G.

As yellow couplers other than the yellow polymer coupler of the present invention, those described in, for example, U.S. Pat. Nos. 3,933,501, 4,022,620, 4,326,024, 44401,752, Japanese Patent Publication No. 10739/83, British Patents 1,425,020, 1,476,760, etc., can be used. The above-described oil-soluble monomer couplers or polymer couplers may be used together with the water-soluble couplers of the present invention in the same layer and/or different layers.

As magenta couplers, 5-pyrazolone type and pyrazoloazole type compounds are preferable, with those described in U.S. Pat. Nos. 4,310,619, 4,351,897, European Patent 73,636, U.S. Pat. Nos. 3,061,432, 3,725,067, *Research Disclosure*, No. 24220 (June, 1984), Japanese Patent Application (OPI) No. 33552/85, *Research Disclosure*, No. 24230 (June, 1984), Japanese Patent Application (OPI) No. 43659/85, U.S. Pat. Nos. 4,500,630, 4,540,654, etc., being particularly preferable.

As cyan couplers, there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent Application (OLS) No. 3,329,729, European Patent 121,365A, U.S. Pat. Nos. 3,446,622, 4,333,999, 4,451,559, 4,427,767, European Patent 161,626A, etc., are preferable.

As colored couplers for correcting unnecessary absorption of colored dyes, those which are described in *Research Disclosure*, No. 17643, VII-G, U.S. Pat. No. 4,163,670, Japanese Patent Publication No. 39413/82, U.S. Pat. Nos. 4,004,929, 4,138,258 and Brisish Patent 1,146,368 are preferable.

As couplers capable of forming colored dyes with a suitable diffusibility, those which are described in U.S. Pat. No. 4,366,237, British Patent 2,125,570, European Patent 96,570 and West German Patent Application (OLS) No. 3,234,533 are preferable.

Typical examples of polymerized dye-forming couplers which can be used with the polymer coupler of the present invention are described in U.S. Pat. Nos.

3,451,820, 4,080,211, 4,367,282, British Patent 2,102,173, etc.

Couplers capable of releasing a photographically useful compound upon coupling reaction are also preferably used in the present invention. As DIR couplers capable of releasing a development inhibitor, those described in patents referred to in the foregoing RD No. 17643, VII-F, Japanese Patent Application (OPI) Nos. 151944/82, 154234/82, 184248/85 and U.S. Pat. No. 4,248,962 are preferable.

As couplers capable of imagewise releasing a nucleating agent or a development accelerator upon development, those described in British Patents 2,097,140, 2,131,188, Japanese Patent Application (OPI) Nos. 157638/84 and 170840/84 are preferable.

As further couplers to be used in the light-sensitive material of the present invention, there are illustrated competitive couplers described in U.S. Pat. No. 4,130,427, etc., polyequivalent couplers described in U.S. Pat. Nos. 4,283,472, 4,338,393, 4,310,618, etc., DIR redox compound-releasing couplers described in Japanese Patent Application (OPI) No. 185950/85, couplers capable of re-acquiring color after being released described in European Patent 173,302A, and the like.

The couplers other than those according to the present invention can be introduced into the photographic material of the present invention according to various techniques known in the art.

Examples of the high boiling point organic solvents to be used in the oil-in-water dispersion process are described in U.S. Pat. No. 2,322,027, etc.

Methods and advantages of the latex dispersion process and specific examples of latex for impregnation are described in U.S. Pat. No. 4,199,363, West German Patent Application (OLS) Nos. 2,541,274, 2,541,230, etc.

Supports preferably used in the present invention are described in, for example, the aforesaid RD No. 17643, p. 28 and ibid., No. 18716, p. 647, right column to p. 648, left column.

The color photographic material in accordance with the present invention may be developed according to processes described in the foregoing RD No. 17643, pp. 28 and 29 and ibid., No. 18716, p. 651, left column to right column.

The color photographic materials of the present invention are usually subjected to a water-washing step or a stabilizing step after development, bleach-fixing, or fixing step.

The water-washing step is generally conducted in a countercurrent manner using two or more baths for saving water. As the stabilizing step, multistage countercurrent stabilizing step as described in Japanese Patent Application (OPI) No. 8543/82 can be employed which substitutes the water-washing step.

The present invention is now illustrated in greater detail by reference to the following examples which, however, are not to be construed as limiting the present invention in any way.

EXAMPLE 1

Color light-sensitive materials comprising a subcoated cellulose triacetate film support having provided thereon the layers of the following formulations, referred to as Samples 101 to 116, were prepared.

Preparation of Sample 101

Formulation of Light-Sensitive Layer

Coated amounts are presented in terms of g/m$^2$ of silver with respect to colloidal silver, g/m$^2$ with respect to couplers, additives, and gelatin, and mol number of silver halide in the same layer with respect to sensitizing dyes.

| | |
|---|---|
| First Layer: Emulsion Layer | |
| Monodispersed AgBrI emulsion of about 15% in coefficient of variation (AgI: 3 mol %; average grain size: 0.5 μm) | 0.6 of Ag |
| Gelatin | 1.0 |
| Coupler C-14 | 1.0 |
| Second Layer: Protective Layer | |
| Gelatin | 0.8 |
| Polymethyl methacrylate particles (diameter: 1.0 μm) | 0.2 |
| Hardener H-1 | 0.1 |

A surfactant was added as a coating aid to each of the above-described layer in addition to the above-described ingredients.

Structural formulae of the compounds used are shown below.

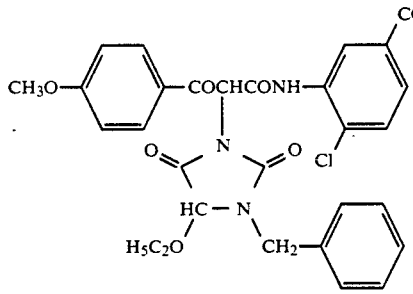

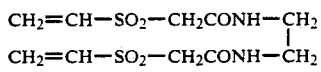

Preparation of Samples 102 to 116

Samples 102 to 116 were prepared in the same manner as with Sample 101 except for replacing Coupler C-14 with equimolar amounts of the couplers shown in Table 1. No high boiling point organic solvent was used.

Separately, samples corresponding to Samples 101 to 116 but having no second layer (protective layer) were prepared for measuring strength of the emulsion film, and Vickers hardness (using a Knoop penetrator) was measured by means of a Terasawa's hardness microtester (model MM-2). Vickers hardness is described in D. Tabor, "The Physical Meaning of Indentation and Scratch Hardness", *British Journal of Applied Physics*, Vol. 7, p. 260 (1956).

With Samples 101 to 116, ethyl acetate was added to each of the oil-soluble couplers (C-14, E-1, E-2, E-3 and E-6) in an 8-fold amount (by weight) and, after heating to dissolve, each of the resulting solutions was mixed with an 8% gelatin aqueous solution (in an amount 2 times the amount of the coupler solution) containing Surfactant W-1. After emulsifying each of the mixtures in a homogenizer, ethyl acetate was removed, and the residue was added to the coating solution.

Water-soluble couplers were added as a 5 wt % aqueous solution to the coating solution.

The coated amount of gelatin was constant with Samples 101 to 116.

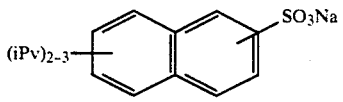

W-1

Samples 101 to 116 were subjected to 25 CMS exposure using a tungsten light source through a filter to adjust the color temperature to 4,800° K., then subjected to development processing at 38° C. according to the following steps (I).

| Processing Steps (I): | |
|---|---|
| Color Development | 3 min 15 sec |
| Bleaching | 6 min 30 sec |
| Washing with Water | 2 min 10 sec |
| Fixing | 4 min 20 sec |
| Washing with Water | 3 min 15 sec |
| Stabilizing | 1 min 05 sec |

Formulations of the processing solutions used in respective steps described above are as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1 liter |
| | pH 10.0 |
| Bleaching Solution: | |
| Ferric Ammoniumethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| Fixing Solution: | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 liter |

-continued

| | |
|---|---|
| | pH 6.6 |
| Stabilizing Solution: | |
| Formalin (40%) | 2.0 ml |
| Polyoxyethylene-p-monononylphenyl Ether (average polymerization degree: 10) | 0.3 g |
| Water to make | 1.0 liter |

In order to examine color image preservability of the thus processed samples, samples stored for 3 days at 80° C. and 70% RH and samples irradiated with a xenon light source (200,000 lux) for 24 hours were prepared, and dark fading and light fading were evaluated.

The results thus obtained are tabulated in Table 1.

TABLE 1

| Sample No. | Coupler | Maximum Density | Wet Heat Fading** | Light Fading** | Film Strength*** (kg/mm²) |
|---|---|---|---|---|---|
| 101 | C-14 | 2.13 | 0.04 | 0.30 | 13 |
| 102 | E-1 | 1.31 | 0.02 | 0.26 | 15 |
| 103 | E-2 | 1.14 | 0.01 | 0.13 | 16 |
| 104 | E-3 | 1.42 | 0.02 | 0.21 | 13 |
| 105 | E-4* | 1.26 | 0.70 | 0.37 | 25 |
| 106 | E-5* | 1.32 | 0.72 | 0.43 | 22 |
| 107 | E-6 | 0.96 | 0.04 | 0.22 | 17 |
| 108 | cp-3* | 1.23 | 0.03 | 0.05 | 25 |
| 109 | cp-4* | 1.21 | 0.03 | 0.06 | 26 |
| 110 | cp-17* | 1.68 | 0.04 | 0.07 | 25 |
| 111 | cp-19* | 1.57 | 0.02 | 0.05 | 25 |
| 112 | cp-20* | 2.10 | 0.21 | 0.14 | 23 |
| 113 | cp-22* | 1.60 | 0.03 | 0.06 | 26 |
| 114 | cp-24* | 1.52 | 0.23 | 0.12 | 25 |
| 115 | cp-26* | 1.46 | 0.04 | 0.04 | 27 |
| 116 | cp-31* | 1.37 | 0.19 | 0.15 | 24 |

*The couplers used in Samples 105, 106, and 108 to 116 are water-soluble.
**The wet heat fading and the light fading values are presented as a reduction in density from an initial density of 1.0
***Vickers hardness In Table 1, Sample Nos. 101 to 107 are the comparative samples, and Sample Nos. 108 to 116 are the samples according to the present invention.

Water-soluble polymer couplers are found to possess better film strength than oil-soluble monomer type couplers and polymer couplers. However, water-soluble yellow couplers having polymerization moiety in color-forming mother nuclei have a serious defect with color image preservability. In contrast, water-soluble yellow couplers having polymerization moiety in coupling-off groups are found to have excellent film strength and color image preservability, and practically enough color-forming properties.

Couplers used in comparative samples are shown below.

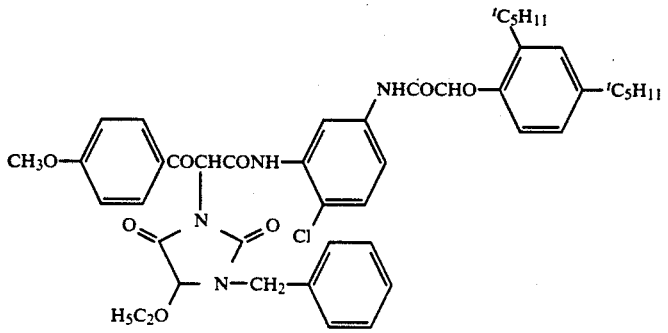

E-1

-continued
E-2
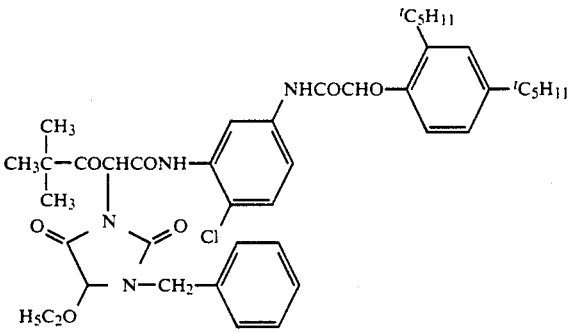
E-3
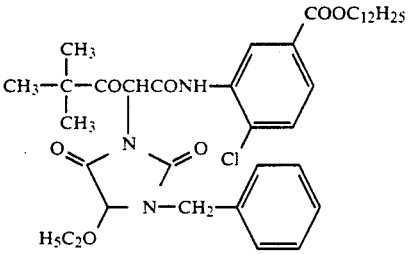
E-4
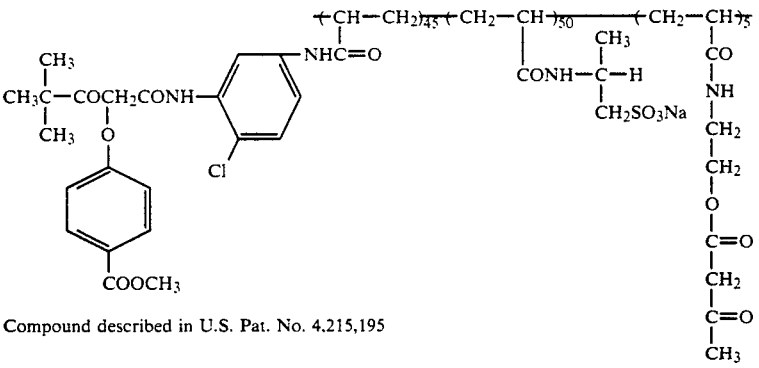
Compound described in U.S. Pat. No. 4,215,195
E-5
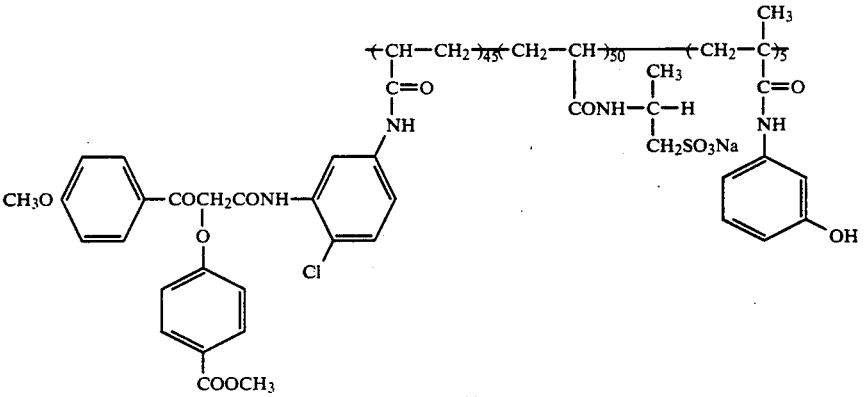
Compound included in the scope of U.S. Pat. No. 4,207,109

-continued

E-6

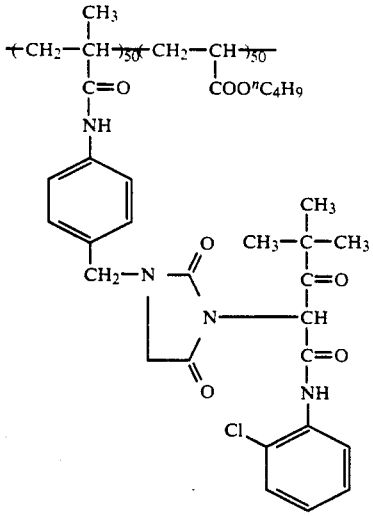

Compound described in Japanese Patent Application (OPI) No. 73151/86

EXAMPLE 2

Preparation of Example 201

A multilayered color light-sensitive material, Sample 201, comprising a sub-coated cellulose triacetate film support having provided thereon the layers of the following formulations was prepared.

Formulation of Layers

Coated amounts are presented in terms of g/m$^2$ of silver with respect to silver halide and colloidal silver, g/m$^2$ with respect to couplers, additives, and gelatin, and mol number per mol of silver halide in the same layer with respect to sensitizing dyes.

| | |
|---|---|
| First Layer: Antihalation Layer | |
| Black colloidal silver | 0.2 |
| Gelatin | 1.3 |
| Colored Coupler C-1 | 0.06 |
| Ultraviolet Ray Absorbent UV-1 | 0.1 |
| Ultraviolet Ray Absorbent UV-2 | 0.2 |
| High Boiling Point Organic Solvent Oil-1 | 0.01 |
| High Boiling Point Organic Solvent Oil-2 | 0.01 |
| Second Layer: Interlayer | |
| Fine AgBr (average grain size: 0.07 μm) | 0.15 |
| Gelatin | 1.0 |
| Colored Coupler C-2 | 0.02 |
| High Boiling Point Organic Solvent Oil-1 | 0.1 |
| Third Layer: First Red-Sensitive Emulsion Layer | |
| AgBrI emulsion (AgI: 2 mol %; average grain size: 0.3 μm) | 0.4 of Ag |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1 \times 10^{-5}$ |
| Coupler C-3 | 0.06 |
| Coupler C-4 | 0.06 |
| Coupler C-8 | 0.04 |
| Coupler C-2 | 0.03 |
| High Boiling Point Organic Solvent Oil-1 | 0.03 |
| High Boiling Point Organic Solvent Oil-3 | 0.012 |
| Fourth Layer: Second Red-Sensitive Emulsion Layer | |
| AgBrI emulsion (AgI: 5 mol %; average grain size: 0.5 μm) | 0.7 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| Coupler C-8 | 0.04 |

-continued

| | |
|---|---|
| Coupler C-2 | 0.04 |
| High Boiling Point Organic Solvent Oil-1 | 0.15 |
| High Boiling Point Organic Solvent Oil-3 | 0.02 |
| Fifth Layer: Third Red-Sensitive Emulsion Layer | |
| Cubic monodispersed AgBrI emulsion (AgI: 10 mol %; mean grain size: 0.7 μm) | 1.0 of Ag |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| High Boiling Point Organic Solvent Oil-1 | 0.01 |
| High Boiling Point Organic Solvent Oil-2 | 0.05 |
| Sixth Layer: Interlayer | |
| Gelatin | 1.0 |
| Compound Cpd-A | 0.03 |
| High Boiling Point Organic Solvent Oil-1 | 0.05 |
| Seventh Layer: First Green-Sensitive Emulsion Layer | |
| AgBrI emulsion (AgI: 4 mol %; average grain size: 0.3 μm) | 0.30 |
| Sensitizing Dye IV | $5 \times 10^{-4}$ |
| Sensitizing Dye VI | $0.3 \times 10^{-4}$ |
| Sensitizing Dye V | $2 \times 10^{-4}$ |
| Gelatin | 1.0 |
| Coupler C-9 | 0.2 |
| Coupler C-5 | 0.03 |
| Coupler C-1 | 0.03 |
| High Boiling Point Organic Solvent Oil-1 | 0.5 |
| Eighth Layer: Second Green-Sensitive Emulsion Layer | |
| AgBrI emulsion (AgI: 5 mol %; average grain size: 0.5 μm) | 0.4 |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| High Boiling Point Organic Solvent Oil-1 | 0.2 |
| Ninth Layer: Third Green-Sensitive Emulsion Layer | |
| Cubic monodispersed AgBrI emulsion (AgI: 6 mol %; average grain size: 0.7 μm) | 0.85 of Ag |
| Gelatin | 1.0 |
| Sensitizing Dye VII | $3.5 \times 10^{-4}$ |
| Sensitizing Dye VIII | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |

-continued

| | |
|---|---|
| High Boiling Point Organic Solvent Oil-1 | 0.20 |
| High Boiling Point Organic Solvent Oil-2 | 0.05 |
| Tenth Layer: Yellow Filter Layer | |
| Gelatin | 1.2 |
| Yellow colloidal silver | 0.08 |
| Compound Cpd-B | 0.1 |
| High Boiling Point Organic Solvent Oil-1 | 0.3 |
| Eleventh Layer: First Blue-Sensitive Emulsion Layer | |
| Monodispersed AgBrI emulsion (AgI: 4 mol %; average grain size: 0.3 μm) | 0.4 of Ag |
| Gelatin | 1.0 |
| Sensitizing Dye IX | $2 \times 10^{-4}$ |
| Coupler C-14 | 0.9 |
| Coupler C-5 | 0.07 |
| Twelfth Layer: Second Blue-Sensitive Emulsion Layer | |
| Cubic monodispersed AgBrI emulsion (AgI: 10 mol %; average grain size: 1.5 μm) | 0.5 of Ag |
| Gelatin | 0.6 |
| Sensitizing Dye IX | $1 \times 10^{-4}$ |

-continued

| | |
|---|---|
| Coupler C-14 | 0.25 |
| Thirteenth Layer: First Protective Layer | |
| Gelatin | 0.8 |
| Ultraviolet Ray Absorbent UV-1 | 0.1 |
| Ultraviolet Ray Absorbent UV-2 | 0.2 |
| High Boiling Point Organic Solvent Oil-1 | 0.01 |
| High Boiling Point Organic Solvent Oil-2 | 0.01 |
| Fourteenth Layer: Second Protective Layer | |
| Fine AgBr (average grain size: 0.07 μm) | 0.5 |
| Gelatin | 0.45 |
| Polymethyl methacrylate particles (diameter: 1.5 μm) | 0.2 |
| Hardener H-1 | 0.4 |
| Formaldehyde Scavenger F-1 | 0.5 |
| Formaldehyde Scavenger F-2 | 0.5 |

A furfactant was added as a coating aid to each of the layers in addition to the above-described ingredients.

Chemical structural formulae or chemical names of the compounds used in the samples according to the present invention are shown below.

UV-1

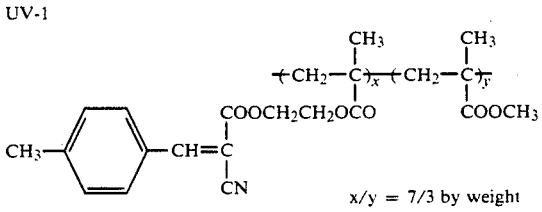

x/y = 7/3 by weight

UV-2

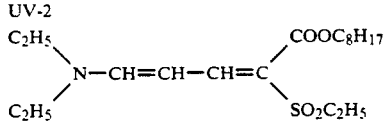

Oil-1: Tricresyl phosphate

Oil-2: Dibutyl phthalate

Oil-3: Bis(2-ethylhexyl) phthalate

C-1

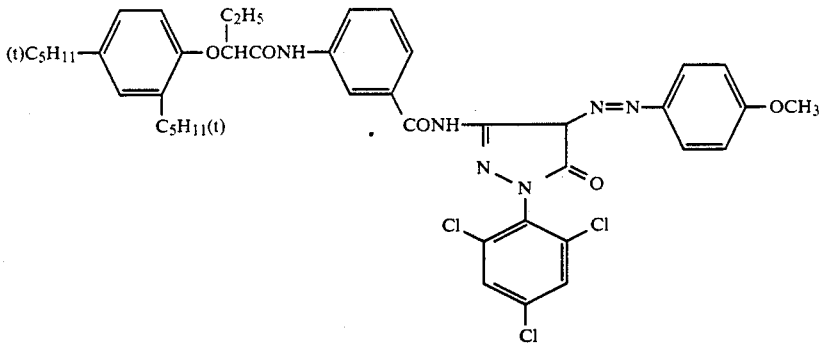

C-2

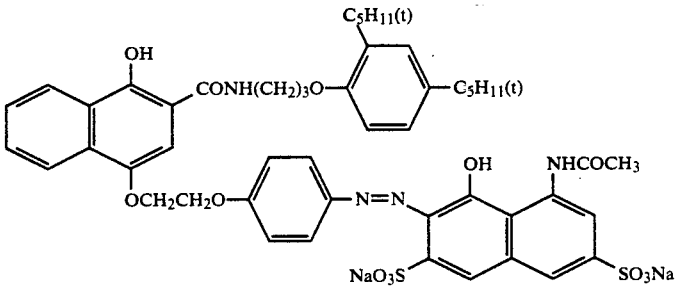

C-3

-continued
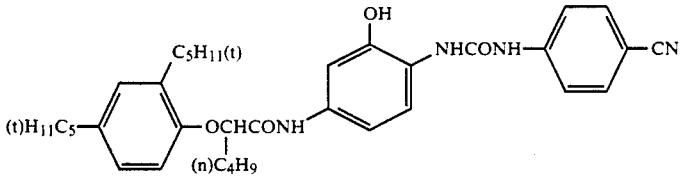
C-4
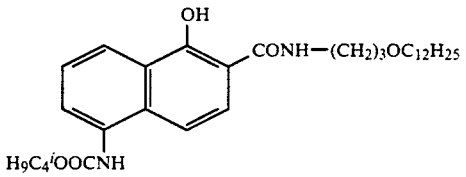
C-5
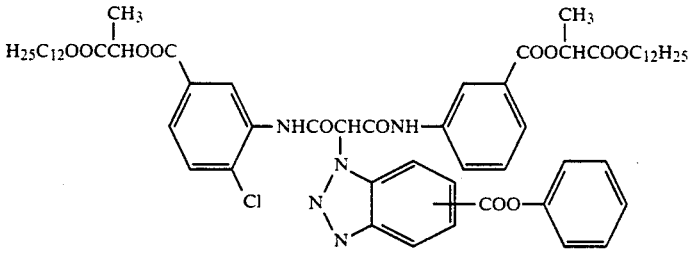
C-6
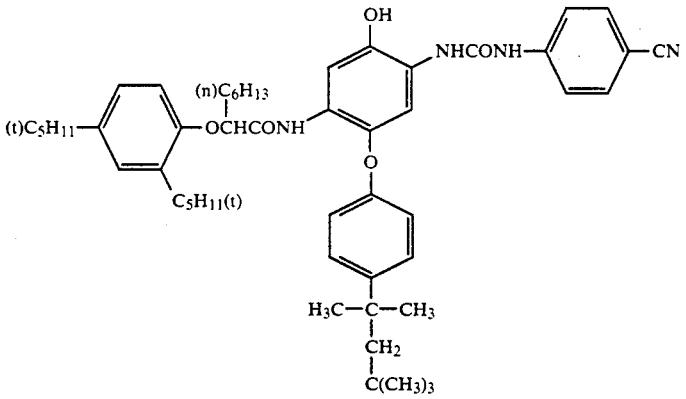
C-7
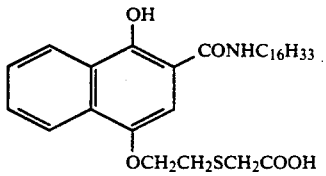
C-8
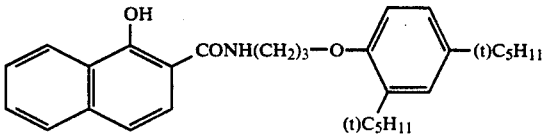
C-9

-continued
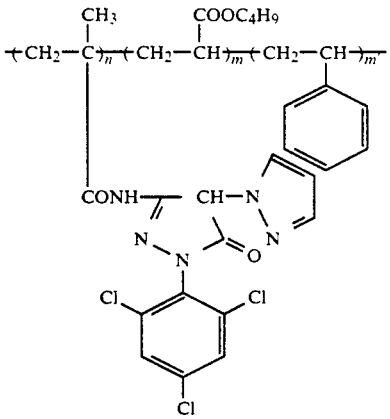
n = 50, m = 25, m' = 25
molecular weight: about 20,000
C-10
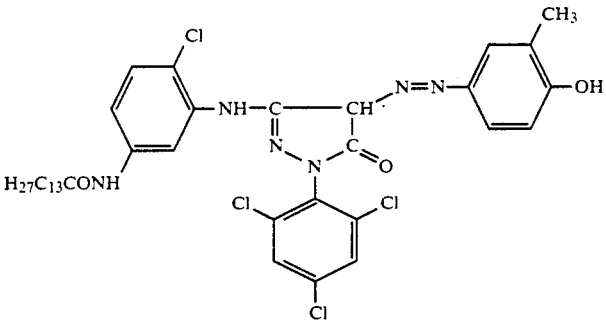
C-11
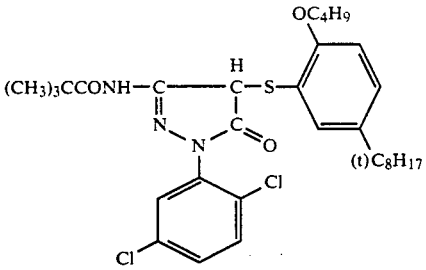
C-12
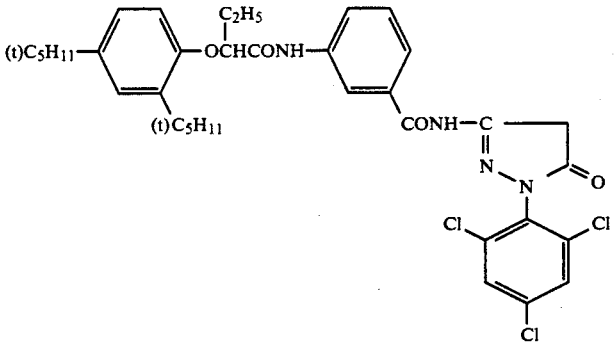
C-13

-continued
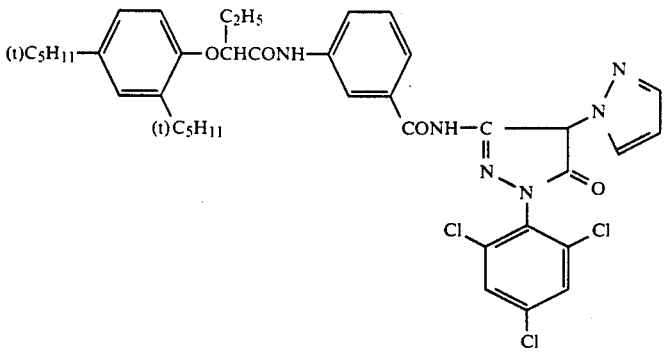
C-14
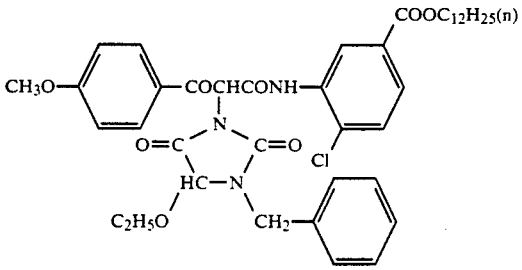
C-15
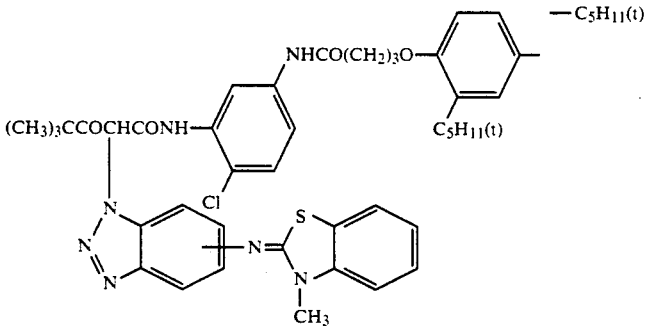
Cpd-A
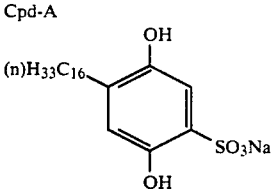
Cpd-B
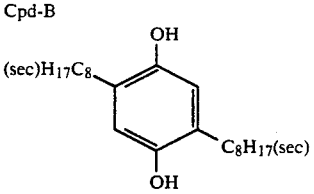
Sensitizing Dye I
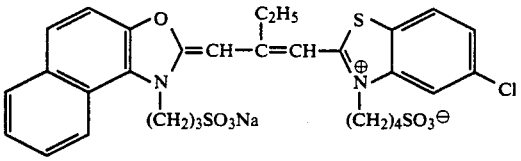
Sensitizing Dye II
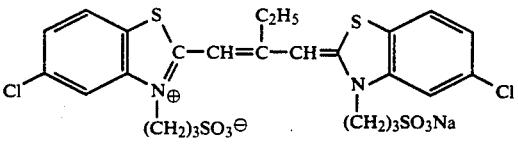
Sensitizing Dye III
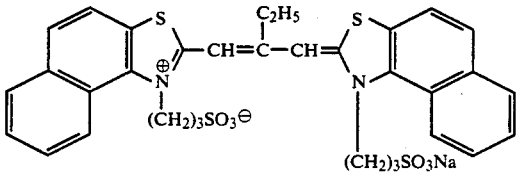
Sensitizing Dye IV -continued

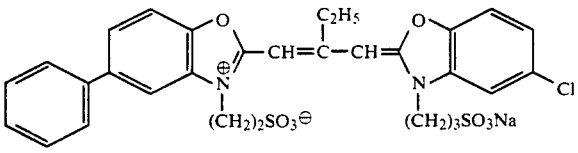

Sensitizing Dye V

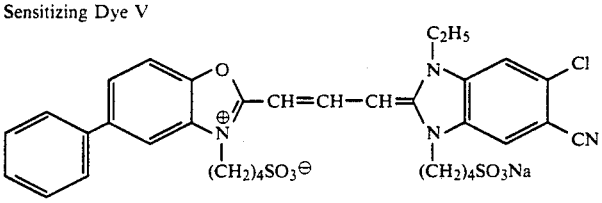

Sensitizing Dye VI

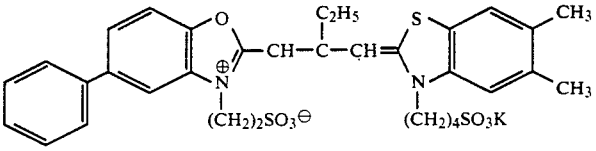

Sensitizing Dye VII

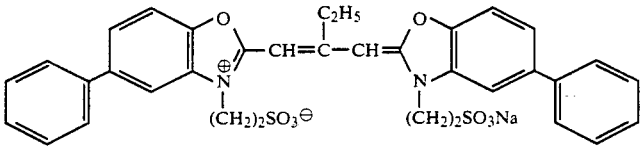

Sensitizing Dye VIII

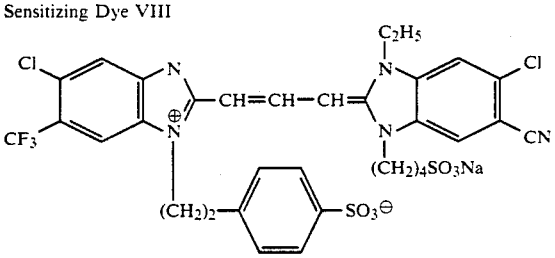

Sensitizing Dye IX

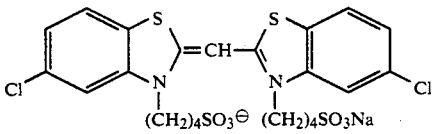

H-1

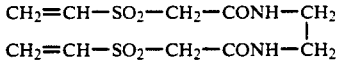

F-1

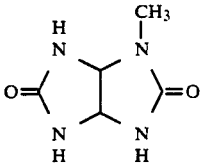

F-2

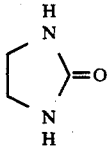

Preparation of Samples 202 to 209

Samples 202 to 209 were prepared in the same manner as with Sample 201 except for replacing Coupler C-14 used in the eleventh and twelfth layers of Sample 201 with an equimolar amount of the compounds given in Table 2.

The thus obtained samples were subjected to the same exposure as in Example 1, then subjected to the following processing steps (II). Color-forming properties and graininess of the resulting samples were evaluated. The results thus obtained are shown in Table 2.

It is apparent that the use of the coupler of the present invention gives excellent color-forming properties and improved graininess. With color image preservability and film strength, the samples were found to be in the same order as in Example 1.

When similar experiments were conducted according to the processing steps (III), there were obtained the same results as with the processing steps (II).

| Processing Steps (II): | | |
|---|---|---|
| Color Development | 3 min 15 sec | 38° C. |
| Bleaching | 30 sec | " |
| Bleach-Fixing | 1 min 30 sec | " |
| Rinsing | 1 min 40 sec | " |
| Stabilizing | 40 sec | " |

Formulations of the processing solutions used in respective steps in the processing steps (II) are as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| | pH 10.0 |
| Bleaching Solution: | |
| Ammonium Bromide | 100 g |
| Ferric Ammonium Ethylenediaminetetraacetate | 120 g |
| Disodium Ethylenediaminetetraacetate | 10.0 g |
| Ammonium Nitrate | 10.0 g |
| Bleaching Promoter | 2.0 g |
| Aqueous Ammonia | 17.0 ml |
| Water to make | 1 liter |
| | pH 6.5 |
| Bleach-Fixing Solution: | |
| Ammonium Bromide | 50.0 g |
| Ferric Ammonium Ethylenediaminetetraacetate | 50.0 g |
| Disodium Ethylenediaminetetraacetate | 5.0 g |
| Ammonium Nitrate | 5.0 g |
| Sodium Sulfite | 12.0 g |
| Ammonium Thiosulfate (70% aq. soln.) | 240 ml |
| Water to make | 1 liter |
| | pH 7.3 |
| Rinsing Solution: | |
| Disodium Ethylenediaminetetraacetate | 0.4 g |
| Water to make | 1 liter |
| pH was adjusted to 7.0 with sodium hyroxide | |
| Stabilizing Solution: | |
| Formaldehyde (40% aq. soln.) | 2.0 ml |
| Polyoxyethylene-p-monononylphenyl Ether (average polymerization degree: about 10) | 0.3 g |
| Water to make | 1.0 liter |

TABLE 2

| Sample No. | Coupler | Color-Forming Properties* | Graininess** |
|---|---|---|---|
| 201 (Comparison) | C-14 | 2.05 | 0.042 |
| 202 " | E-3 | 1.61 | 0.036 |
| 203 " | E-4 | 1.22 | 0.035 |
| 204 " | E-5 | 1.24 | 0.036 |
| 205 " | E-6 | 0.98 | 0.026 |
| 206 (Invention) | cp-3 | 1.59 | 0.025 |
| 207 " | cp-4 | 1.62 | 0.024 |
| 208 " | cp-20 | 2.01 | 0.027 |
| 209 " | cp-24 | 2.02 | 0.029 |

*Value calculated by subtracting Dmin from the yellow density obtained by 20 CMS exposure.
**RMS value (density: 2.0) measured through measuring opening of 48 mm diameter.

| Processing Steps (III): | | |
|---|---|---|
| Color Development | 3 min 15 sec | 38° C. |

-continued

| Processing Steps (III): | | |
|---|---|---|
| Bleach-Fixing | 2 min 00 sec | " |
| Washing with Water | 1 min 40 sec | " |
| Stabilizing | 40 sec | " |

Formulations of the processing solutions used in respective steps in the processing steps (III) are as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1 liter |
| | pH 10.00 |
| Bleach-Fixing Solution: | |
| Ferric Ammonium Ethylenediaminetetraacetate | 80.0 g |
| Disodium Ethylenediaminetetraacetate | 10.0 g |
| Bleaching Promoter | 1.5 g |
| Sodium Sulfite | 12.0 g |
| Ammonium Thiosulfate (70% aq. soln.) | 240 ml |
| Water to make | 1 liter |
| pH was adjusted to 6.8 with aqueous ammonia (28%) | |

Washing Water

Tap water was used after passing through a column filled with a 1:1 (by volume) mixture of H-type strongly acidic cation exchange resin (Amberlite IR-120 B; made by Rohm & Haas Co.) and OH-type strongly basic anion exchange resin (Amberlite IRA-400; made by Rohm & Haas Co.) to reduce the concentrations of calcium and magnesium to levels of not more than 1 mg/liter and adding thereto 0.02 g of sodium dichloroisocyanurate per liter.

| Stabilizing Solution: | |
|---|---|
| Formaldehyde (37% w/v) | 2.0 ml |
| Polyoxyethylene-p-monononylphenyl Ether (average polymerization degree: 10) | 0.3 g |
| Disodium Ethylenediaminetetraacetate | 0.05 g |
| Water to make | 1 liter |
| | pH 6.0 |

EXAMPLE 3

A multilayered color light-sensitive material, Sample 301, comprising a sub-coated cellulose triacetate film support having provided thereon layers of the following formulation was prepared.

| | |
|---|---|
| First Layer: Antihalation Layer | |
| A gelatin layer (dry thickness: 2 μm) containing: | |
| Black colloidal silver | 0.25 g/m$^2$ |
| UV Ray Absorbent U-1 | 0.04 g/m$^2$ |
| UV Ray Absorbent U-2 | 0.1 g/m$^2$ |
| UV Ray Absorbent U-3 | 0.1 g/m$^2$ |
| High Boiling Point Organic Solvent Oil-2 | 0.01 cc/m$^2$ |
| Second Layer: Interlayer | |
| A gelatin layer (dry thickness: 1 μm) containing: | |
| Compound Cpd-C | 0 05 g/m$^2$ |

-continued

| | |
|---|---|
| Compound I-1 | 0 05 g/m$^2$ |
| High Boiling Point Organic Solvent Oil-1 | 0.05 cc/m$^2$ |
| Third Layer: | |
| First Red-Sensitive Emulsion Layer | |
| A gelatin layer (dry thickness: 1 μm) containing: | |
| AgBrI emulsion (average grain size: 0.3 μm; AgI content: 4 mol %) spectrally sensitized with Sensitizing Dyes S-1 and S-2 | 0.5 g of Ag/m$^2$ |
| Coupler F-1 | 0.2 g/m$^2$ |
| Coupler F-2 | 0.05 g/m$^2$ |
| Compound I-2 | $2 \times 10^{-3}$ g/m$^2$ |
| High Boiling Point Organic Solvent Oil-1 | 0.12 cc/m$^2$ |
| Fourth Layer: | |
| Second Red-Sensitive Emulsion Layer | |
| A gelatin layer (dry thickness: 2.5 μm) containing: | |
| AgBrI emulsion (average grain size: 0.6 μm; AgI content: 3 mol %) spectrally sensitized with Sensitizing Dyes S-1 and S-2 | 0.8 g of Ag/m$^2$ |
| Coupler F-1 | 0.55 g/m$^2$ |
| Coupler F-2 | 0.14 g/m$^2$ |
| Compound I-2 | $1 \times 10^{-3}$ g/m2 |
| High Boiling Point Organic Solvent Oil-1 | 0.33 cc/m$^2$ |
| Dye D-1 | 0.02 g/m$^2$ |
| Fifth Layer: Interlayer | |
| A gelatin layer (dry thickness: 1 μm) containing: | |
| Compound Cpd-C | 0.1 g/m$^2$ |
| High Boiling Point Organic Solvent Oil-1 | 0.1 cc/m$^2$ |
| Dye D-2 | 0.02 g/m$^2$ |
| Sixth Layer: | |
| First Green-Sensitive Emulsion Layer | |
| A gelatin layer (dry thickness: 1 μm) containing: | |
| AgBrI emulsion (average grain size: 0.3 μm; AgI content: 4 mol %) containing Sensitizing Dyes S-3 and S-4 | 0.7 g of Ag/m$^2$ |
| Coupler F-3 | 0.20 g/m$^2$ |
| Coupler F-5 | 0.10 g/m$^2$ |
| High Boiling Point Organic Sovlent Oil-1 | 0.26 cc/m$^2$ |
| Seventh Layer: | |
| Second Green-Sensitive Emulsion Layer | |
| A gelatin layer (dry thickness: 2.5 μm) containing: | |
| AgBrI emulsion (average grain size: 0.6 μm; AgI content: 2.5 mol %) containing Sensitizing Dyes S-3 and S-4 | 0.7 g of Ag/m$^2$ |
| Coupler F-4 | 0.10 g/m$^2$ |
| Coupler F-5 | 0.10 g/m$^2$ |
| High Boiling Point Organic Solvent Oil-2 | 0.05 cc/m$^2$ |
| Dye D-3 | 0.05 g/m$^2$ |
| Eighth Layer: Interlayer | |
| A gelatin layer (dry thickness: 1 μm) containing: | |
| Compound Cpd-C | 0.05 g/m$^2$ |
| High Boiling Point Organic Solvent Oil-2 | 0.1 cc/m$^2$ |
| Dye D-4 | 0.01 g/m$^2$ |
| Ninth Layer: Yellow Filter Layer | |
| A gelatin layer (dry thickness: 1 μm) containing: | |
| Yellow colloidal silver | 0.1 g/m$^2$ |
| Compound Cpd-C | 0.02 g/m$^2$ |
| Compound Cpd-B (same as in Ex. 1) | 0.03 g/m$^2$ |
| High Boiling Point Organic Solvent Oil-1 | 0.04 cc/m$^2$ |
| Tenth Layer: | |
| First Blue-Sensitive Emulsion Layer | |
| A gelatin layer (dry thickness: 1.5 μm) containing: | |
| AgBrI emulsion (average grain size: 0.3 μm; AgI content: 2 mol %) containing Sensitizing Dye S-5 | 0.6 g of Ag/m$^2$ |
| Coupler F-6 | 0.5 g/m$^2$ |
| Eleventh Layer: | |
| Second Blue-Sensitive Emulsion Layer | |
| A gelatin layer (dry thickness: 3 μm) containing: | |
| AgBrI emulsion (average grain size: 0.6 μm; AgI content: 2 mol %) containing Sensitizing Dye S-6 | 1.1 g of Ag/m$^2$ |
| Coupler F-6 | 1.3 g/m$^2$ |
| Dye D-5 | 0.02 g/m$^2$ |
| Twelfth Layer: First Protective Layer | |
| A gelatin layer (dry thickness: 2 μm) containing: | |

-continued

| | |
|---|---|
| UV Ray Absorbent U-1 | 0.02 g/m$^2$ |
| UV Ray Absorbent U-2 | 0.32 g/m$^2$ |
| UV Ray Absorbent U-3 | 0.03 g/m$^2$ |
| High Boiling Point Organic Solvent Oil-2 | 0.28 g/m$^2$ |
| Thirteenth Layer: Second Protective Layer | |
| A gelatin layer (dry thickness: 1.5 μm) containing: | |
| Surface-fogged fine grain AgBrI emulsion (iodide content: 1 mol %; average grain size: 0.06 μm) Polymethyl methacrylate particles (average particle size: 1.5 μm) | 0.1 g of Ag/m$^2$ |

Gelatin Hardener H-1 (the same as in Example 1) and a surfactant were added to each of the above-described layers in addition to the above-described ingredients.

Compounds used for preparing the sample are shown below.

F-1

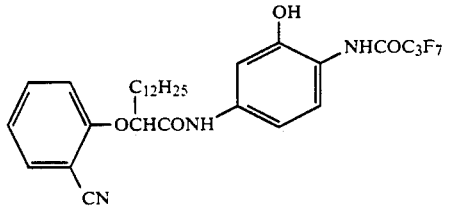

F-2

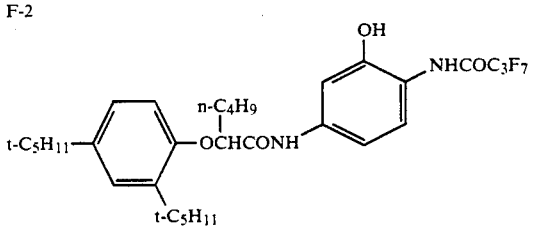

F-3

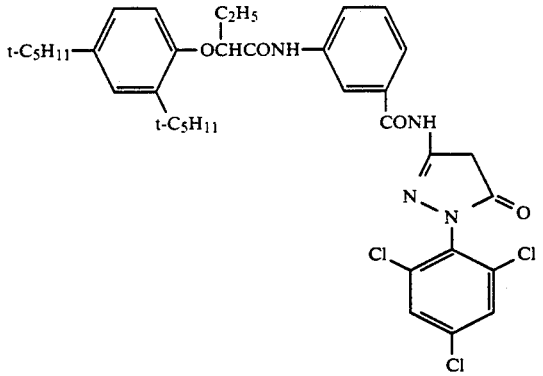

F-4

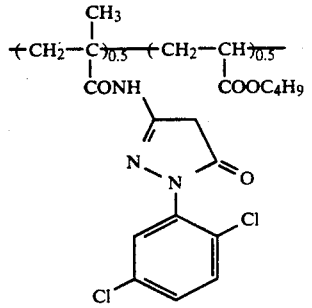

-continued
F-5
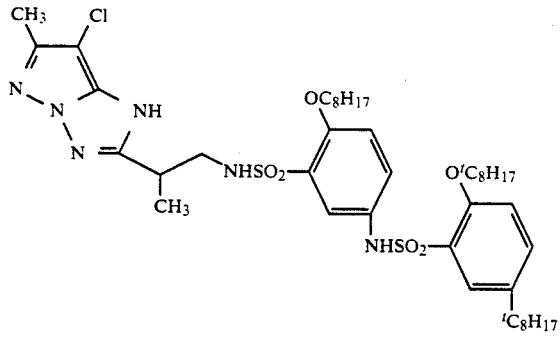
F-6
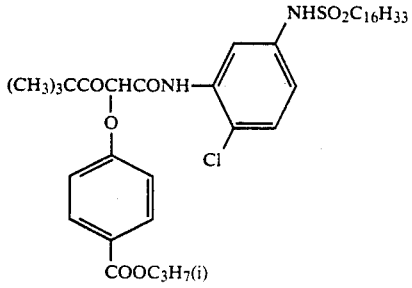
Compound I-1
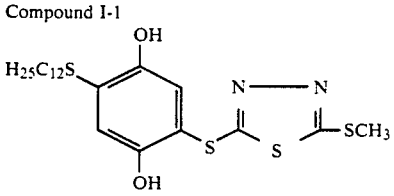
Compound I-2
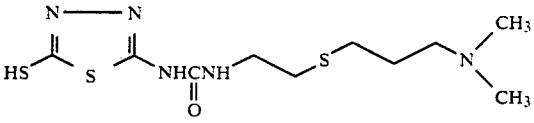
U-1
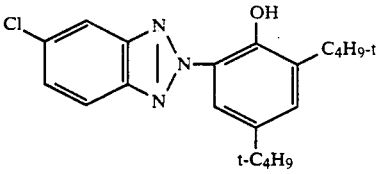
U-2
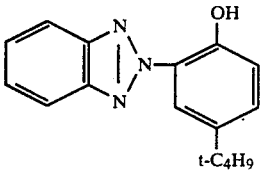
U-3
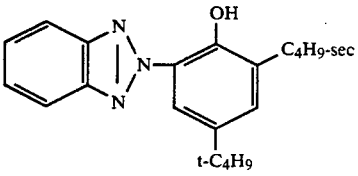
Cpd-C
-continued
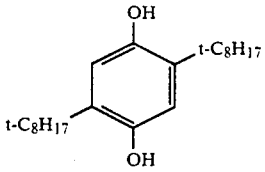
S-1
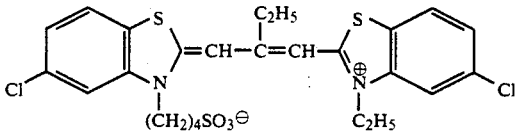
S-2
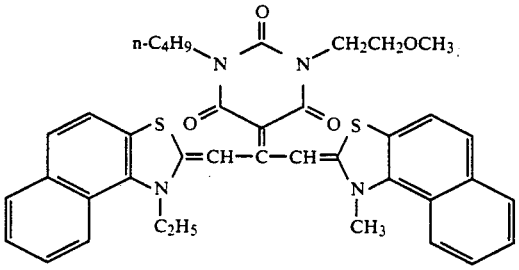
S-3
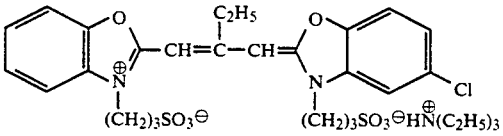
S-4
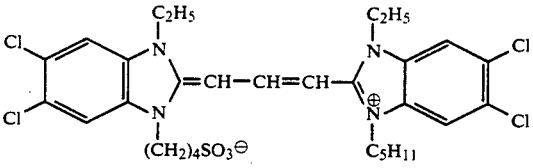
S-5
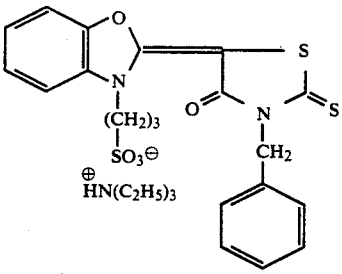
S-6
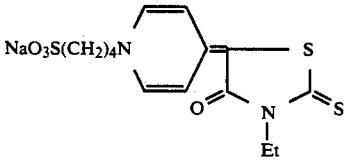
D-1

-continued

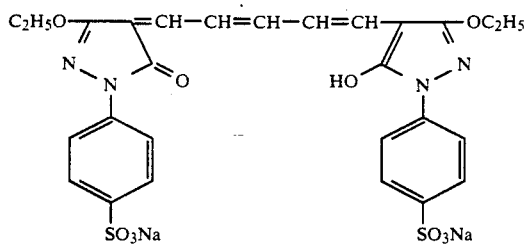

D-2

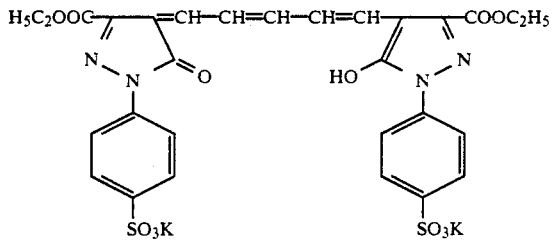

D-3

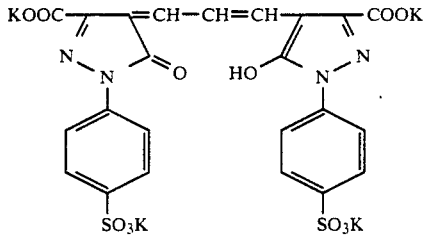

D-4

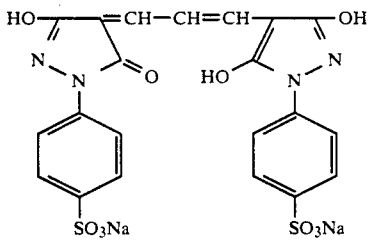

D-5

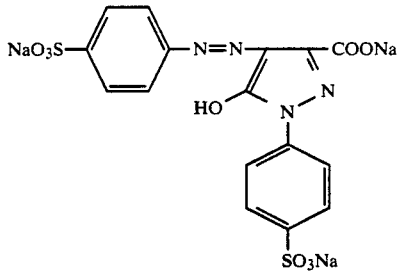

High Boiling Point Organic Solvents Oil-1 and Oil-2 are the same as used in Example 2.

Emulsion grains used in the tenth and the eleventh layers of Sample 301 comprised tabular twin crystals of 8 in aspect ratio.

Preparation of Samples 302 to 311

Samples 302 to 311 were prepared in the same manner as with Sample 301 except for replacing Coupler F-6 used in the tenth and the eleventh layers of Sample 301 with the couplers shown in Table 3.

The thus obtained Samples 301 to 311 were wedge exposed using white light, then processed as follows:

Photographic properties and graininess of the processed samples were evaluated. Further, film strength of undeveloped samples was evaluated by scratching with a thin needle.

The results thus obtained are shown in Table 3. It is apparent that all of the samples of the present invention were excellent.

| Processing Steps (IV): | | |
|---|---|---|
| Step | Time (min) | Temperature |
| First Development | 6 | 38° C. |
| Washing with Water | 2 | " |
| Reversing | 2 | " |
| Color Development | 6 | " |
| Adjustment | 2 | " |
| Bleaching | 6 | " |
| Fixing | 4 | " |
| Washing with Water | 4 | " |
| Stabilizing | 1 | Ordinary Temperature |
| Drying | | |

Formulations of used processing solutions are as follows.

| | |
|---|---|
| First Developer: | |
| Water | 700 ml |
| Pentasodium Nitrilo-N,N,N-trimethylene-phosphonate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1,000 ml |
| Reversing Solution: | |
| Water | 700 ml |
| Pentasodium Nitrilo-N,N,N-trimethylene-phosphonate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Pentasodium Nitrilo-N,N,N-trimethylene-phosphonate | 3 g |
| Sodium Sulfite | 7 g |
| Sodium Tertiary Phosphate (dodecahydrate) | 36 g |
| Potassium Bromide | 1 g |
| Potassium Iodide (0.1% soln.) | 90 ml |
| Sodium Hydroxide | 3 g |
| Citrazinic Acid | 1.5 g |
| N-Ethyl-N-(β-methanesulfonamidoethyl)-3-methyl-4-aminoaniline Sulfate | 11 g |
| 3,6-Dithiaoctane-1,8-diol | 1 g |
| Water to make | 1,000 ml |
| Adjusting Solution: | |
| Water | 700 ml |
| Sodium Sulfite | 12 g |
| Sodium Ethylenediaminetetraacetate (dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate | 2 g |

-continued

| | |
|---|---|
| (dihydrate) | |
| Iron(III) Ammonium Ethylenediamine-tetraacetate (dihydrate) | 120 g |
| Potassium Bromide | 100 g |
| Water to make | 1,000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formaldehyde (37 wt %) | 5.0 ml |
| Fuji Driwel (surfactant made by Fuji Photo Film Co., Ltd.) | 5.0 ml |
| Water to make | 1,000 ml |

TABLE 3

| Sample No. | Coupler No. | Maximum Density (Dmax) | Graininess* | Film Strength** |
|---|---|---|---|---|
| 301 (Comparison) | F-6 | 3.24 | 0.050 | C |
| 302 " | E-2 | 2.52 | 0.041 | B |
| 303 " | E-3 | 2.95 | 0.043 | C |
| 304 " | E-4 | 2.66 | 0.045 | A |
| 305 " | E-6 | 2.80 | 0.034 | C |
| 306 (Invention) | cp-3 | 2.72 | 0.033 | A |
| 307 " | cp-4 | 2.80 | 0.032 | A |
| 308 " | cp-17 | 3.15 | 0.036 | A |
| 309 " | cp-19 | 3.10 | 0.036 | A |
| 310 " | cp-22 | 2.90 | 0.035 | A |
| 311 " | cp-26 | 2.76 | 0.031 | A |

*RMS value at a density of 1.0

**Liability of flaw formation when scratched by a 0.1 mm needle with varying loads was organoleptically evaluated in terms of: A (good), B (bad), and C (very bad).

While the invention has been described in detail and with reference to specific embodiments thereof, it will be apparent to one skilled in the art that various changes and modifications can be made therein without departing from the spirit and scope thereof.

What is claimed is:

1. A silver halide color photographic material dye comprising a support having provided thereon at least one water-soluble yellow dye-forming polymer coupler which produces, upon coupling with the oxidation product of a color developing agent, a dye containing a repeating unit derived from at least one monomer represented by formula (I)

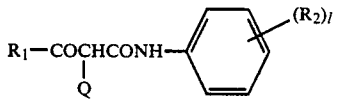

(I)

wherein $R_1$ represents an alkyl group or an aryl group;

$R_2$ represents a monovalent group;

Q represents a group represented by formula (II)

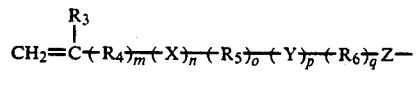

(II)

wherein $R_3$ represents a hydrogen atom or an alkyl group; $R_4$, $R_5$, and $R_6$ each may be the same or different, and represents an alkylene group having from 1 to 20 carbon atoms, an arylene group having from 1 to 20 carbon atoms, or an aralkylene group having from 1 to 20 carbon atoms; X represents —CONH—, —NHCO—, —NHCONH—, —CCO—, —OCO—, —$SO_2$—, —S—, —CO—, —SO—, or —O—; Y represents —CONH—, —NHCO—, —NHCONH—, —COO—, —OCO—, —$SO_2$NH—, —NH$SO_2$—, or —$SO_2$—; m, n, o, p, and q each may be the same or different, and represent 0 or 1; and Z represents a coupling-off group represented by formula (III) or (IV)

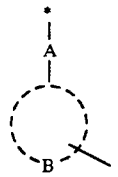

(III)

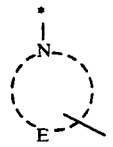

(IV)

wherein * represents a position to be bound to the active site of said coupler; A represents an oxygen atom or a sulfur atom; B represents a non-metallic atomic group necessary for forming an aryl ring or a heterocyclic ring; and E represents a non-metallic atomic group necessary for forming a 5- or 6-membered heterocyclic ring together with the nitrogen atom; whereby said material is developable by a wet process.

2. A silver halide color photographic material as claimed in claim 1, wherein said water-soluble yellow dye-forming polymer coupler is incorporated in said silver halide color photographic material by dissolving said polymer coupler in water, a water-soluble organic solvent, an alkali-containing aqueous solution, or a mixed solvent thereof; adding thus obtained solution to a coating solution; and then coating said coating solution on said support followed by drying.

3. A silver halide color photographic material as claimed in claim 1, wherein $R_1$ represents a straight or branched alkyl group containing from 3 to 20 carbon atoms or a phenyl group.

4. A silver halide color photographic material as claimed in claim 3, wherein $R_1$ represents a straight or branched alkyl group containing from 4 to 8 carbon atoms.

5. A silver halide color photographic material as claimed in claim 3, wherein $R_1$ represents a phenyl group having a substituent of an alkoxy group, a halogen atom, an alkyl group, or an alkylsulfonamido group.

6. A silver halide color photographic material as claimed in claim 1, wherein $R_2$ represents a halogen atom, an alkyl group containing from 1 to 8 carbon atoms, an alkoxy group, an aryloxy group, an alkylsulfonamido group, an arylsulfonamido group, an alkoxycarbonyl group, an aryloxycarbonyl group, an acylamino group, an alkylsulfamoyl group, an arylsulfamoyl group, an alkylcarbamoyl groiup, an arylcarbamoyl group, a sulfonyl group, a nitro group, or a cyano group.

7. A silver halide color photographic material as claimed in claim 6, wherein $R_2$ represents a halogen atom, an alkoxy group, an alkylsulfonamido group, an acylamino group, and an alkoxycarbonyl group.

8. A silver halide color photographic material as claimed in claim 1, wherein X represents —CONH—, —NHCONH—, —COO—, —$SO_2$—, —S—, or —O—; and Y represents —CONH—, —OCO—, —$SO_2NH$—, or —$SO_2$—.

9. A silver halide color photographic material as claimed in claim 1, wherein said polymer coupler contains said repeating unit derived from said monomer represented by formula (I) in an amount of from 5 to 80 wt % based on the total amount of said polymer coupler.

10. A silver halide color photographic material as claimed in claim 9, wherein said polymer coupler contains said repeating unit derived from said monomer represented by formula (I) in an amount of from 30 to 70 wt % based on the total amount of said polymer coupler.

11. A silver halide color photographic material as claimed in claim 1, wherein the molecular weight of said polymer coupler is in the range of from $5\times10^3$ to $1\times10^7$.

12. A silver halide color photographic material as claimed in claim 11, wherein the molecular weight of said polymer coupler is in the range of from $1\times10^4$ to $2\times10^6$.

13. A silver halide color photographic material as claimed in claim 1, wherein the amount of said water-soluble yellow dye-forming polymer coupler is from $1\times10^{-3}$ to 1 mol as color forming units per mol of silver halide.

14. A silver halide color photographic material as claimed in claim 13, wherein the amount of said water-soluble yellow dye-forming polymer coupler is from $1\times10^{-3}$ to 0.2 mol as color forming units per mol of silver halide.

15. A silver halide color photographic material as claimed in claim 1, wherein said water-soluble yellow dye-forming polymer coupler is an α-pivaloylacetanilide series yellow coupler.

* * * * *